US009561652B2

(12) United States Patent
Shimosato et al.

(10) Patent No.: US 9,561,652 B2
(45) Date of Patent: Feb. 7, 2017

(54) INKJET PRINTER HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Masashi Shimosato, Shizuoka (JP); Hideaki Nishida, Shizuoka (JP); Keizaburo Yamamoto, Shizuoka (JP); Ryutaro Kusunoki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/210,016

(22) Filed: Jul. 14, 2016

(65) Prior Publication Data

US 2016/0318304 A1 Nov. 3, 2016

Related U.S. Application Data

(62) Division of application No. 14/600,138, filed on Jan. 20, 2015, now Pat. No. 9,421,768.

(30) Foreign Application Priority Data

Apr. 2, 2014 (JP) ..... 2014-076122
Apr. 2, 2014 (JP) ..... 2014-076123
Apr. 2, 2014 (JP) ..... 2014-076124

(51) Int. Cl.
*B41J 2/14* (2006.01)

(52) U.S. Cl.
CPC ..... *B41J 2/14201* (2013.01); *B41J 2/1433* (2013.01)

(58) Field of Classification Search
CPC ..... B41J 2/1433; B41J 2/14201
See application file for complete search history.

(56) References Cited

U.S. PATENT DOCUMENTS 4,591,883 A * 5/1986 Isayama ..... B41J 2/14201 347/54
5,612,725 A * 3/1997 Okimoto ..... B41J 2/14233 347/68

(Continued)

FOREIGN PATENT DOCUMENTS

JP 2001-246745 9/2001
JP 2002-113861 4/2002

(Continued)

OTHER PUBLICATIONS

Non-Final Office Action for U.S. Appl. No. 14/600,138 dated Dec. 17, 2015, 44 pages.
"MEMSnet Material Database" https://www.memsnet.org/material/siliconsibulk/ (Dec. 12, 2015).

*Primary Examiner* — Julian Huffman
*Assistant Examiner* — Michael Konczal
(74) *Attorney, Agent, or Firm* — Amin, Turocy & Watson LLP

(57) ABSTRACT

In accordance with one embodiment, an inkjet head comprises a plurality of groove-shaped pressure chambers formed on piezoelectric members of which the polarization directions are opposite, and a nozzle plate arranged at the lateral side of the pressure chambers across a lid section with high rigidity. A plurality of through holes connected to a plurality of nozzles formed on the nozzle plate is formed in the lid section. The inkjet head is set in a range of 10~25% before and after a center, that is, a length ratio where the relation between ejection voltage of ink ejected from the nozzles and a length ratio between the length of the through hole of the lid section in the longitudinal direction of the (Continued)

pressure chamber and the length of the pressure chamber in the longitudinal direction of the pressure chamber is minimized.

10 Claims, 15 Drawing Sheets

(56) References Cited

U.S. PATENT DOCUMENTS

| | | | | |
|---|---|---|---|---|
| 6,854,820 | B2 * | 2/2005 | Murakami | B41J 2/1404 347/12 |
| 7,204,579 | B2 | 4/2007 | Kodama | |
| 8,226,210 | B2 | 7/2012 | Otokita | |
| 9,421,768 | B2 * | 8/2016 | Shimosato | B41J 2/1433 |
| 2010/0238215 | A1 | 9/2010 | Kusunoki | |
| 2013/0050338 | A1 | 2/2013 | Shimosato | |

FOREIGN PATENT DOCUMENTS

| | | |
|---|---|---|
| JP | 2002-137384 | 5/2002 |
| JP | 2008-142965 | 6/2008 |
| WO | 9919147 | 4/1999 |
| WO | 0029217 | 5/2000 |
| WO | 0112442 | 2/2001 |
| WO | 0149493 | 7/2001 |
| WO | 03022585 | 3/2003 |

* cited by examiner (A)

(B)

(C)

INKJET PRINTER HEAD

CROSS-REFERENCE TO RELATED APPLICATIONS

This application is a Division of application Ser. No. 14/600,138 filed Jan. 20, 2015, the entire contents of which are incorporated herein by reference.

The present application is based upon and claims the benefit of priorities from Japanese Patent Application No. 2014-076122 filed on Apr. 2, 2014, Japanese Patent Application No. 2014-076123 filed on Apr. 2, 2014, and Japanese Patent Application No. 2014-076124 filed on Apr. 2, 2014, the entire contents of each of which are hereby incorporated by reference.

FIELD

Embodiments described herein relate generally to an inkjet printer head.

BACKGROUND

As an inkjet printer head, for example, there is known a side shooter type device serving as a share mode share wall type inkjet printer head equipped with nozzles at the lateral side of a pressure chamber. Such an inkjet head includes a substrate, a frame member adhered to the substrate, a nozzle plate adhered to the frame member, a piezoelectric member adhered to the substrate at a position inside the frame member and a head drive IC for driving the piezoelectric member. In the printing process, the piezoelectric member is driven, and pillars serving as driving elements arranged at both sides of each pressure chamber in the piezoelectric member are curved by performing shear mode deformation, and in this way, the ink in the pressure chamber is pressurized, and ink drops are ejected from the nozzles.

In a case of a conventional inkjet printer head in which a soft nozzle plate made of resin is fixed on the piezoelectric member, the nozzle plate may also be deformed when each pressure chamber in the piezoelectric member is deformed. As a result, there is a possibility that part of the driving force of the piezoelectric member is used for the deformation of the nozzle plate.

Further, there is also an inkjet printer head in which, for example, a metal lid member with high rigidity is arranged between the piezoelectric member and the nozzle plate. In this case, the fixing part of the lid member and the pressure chamber is firmly connected, in this way, it is possible to prevent that part of the driving force of the piezoelectric member is used for the deformation of the nozzle plate and that the ink ejection efficiency is decreased.

However, the conventional inkjet printer head does not pay much attention to the relation between the nozzle diameter of the nozzle plate serving as a resin member with nozzles and the diameter of through holes of the metal lid section laminated on the nozzle plate.

DETAILED DESCRIPTION

In accordance with one embodiment, an inkjet head comprises a plurality of groove-shaped pressure chambers formed on piezoelectric members of which the polarization directions are opposite, and a nozzle plate arranged at the lateral side of the pressure chambers across a lid section with high rigidity. A plurality of through holes connected to a plurality of nozzles formed on the nozzle plate is formed in the lid section. The inkjet head is set in a range of 10~25% before and after a center, that is, a length ratio where the relation between ejection voltage of ink ejected from the nozzles and a length ratio between the length of the through hole of the lid section in the longitudinal direction of the pressure chamber and the length of the pressure chamber in the longitudinal direction of the pressure chamber is minimized.

A First Embodiment

Constitution

Figure 1:
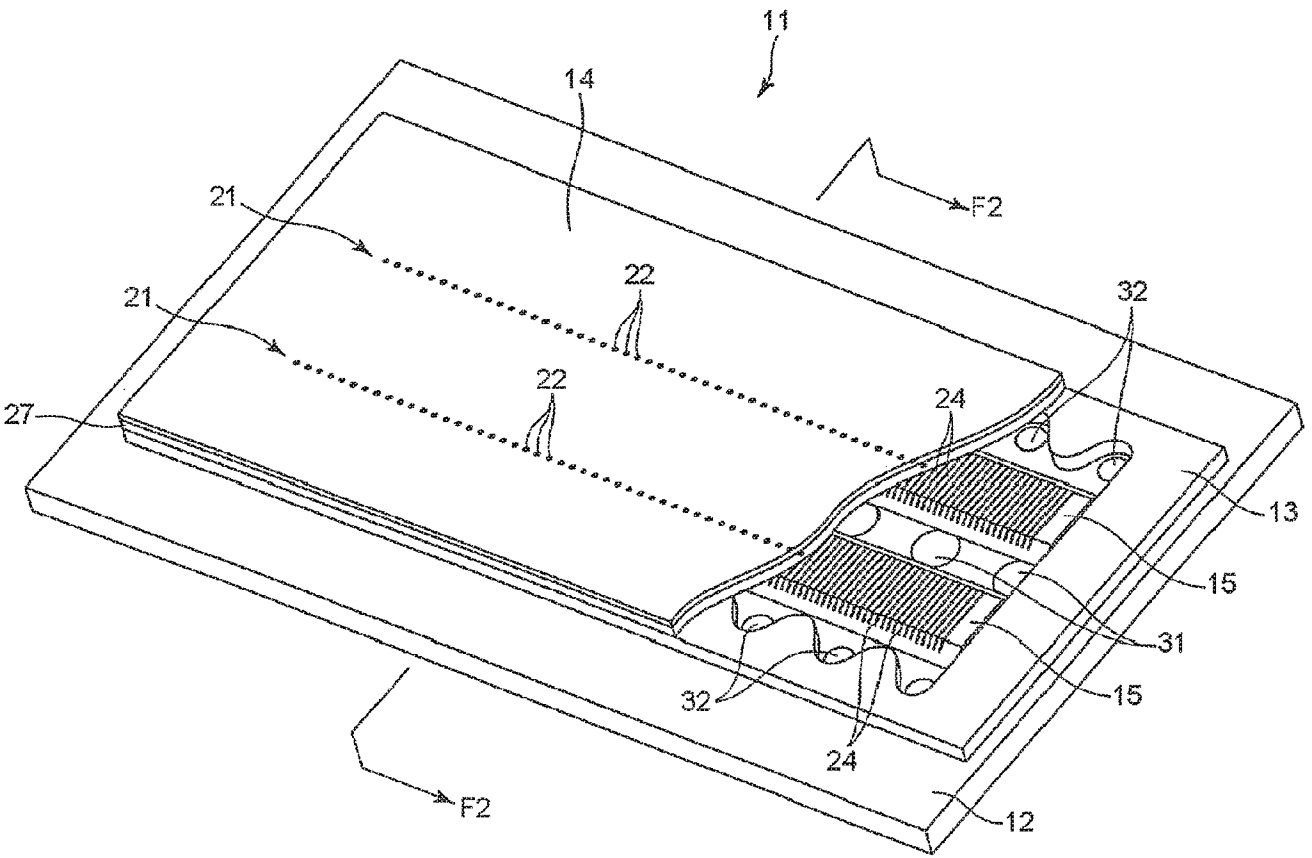
FIG. 1 is a perspective view of an inkjet head according to a first embodiment in which one part of the inkjet head is broken.
Figure 2:
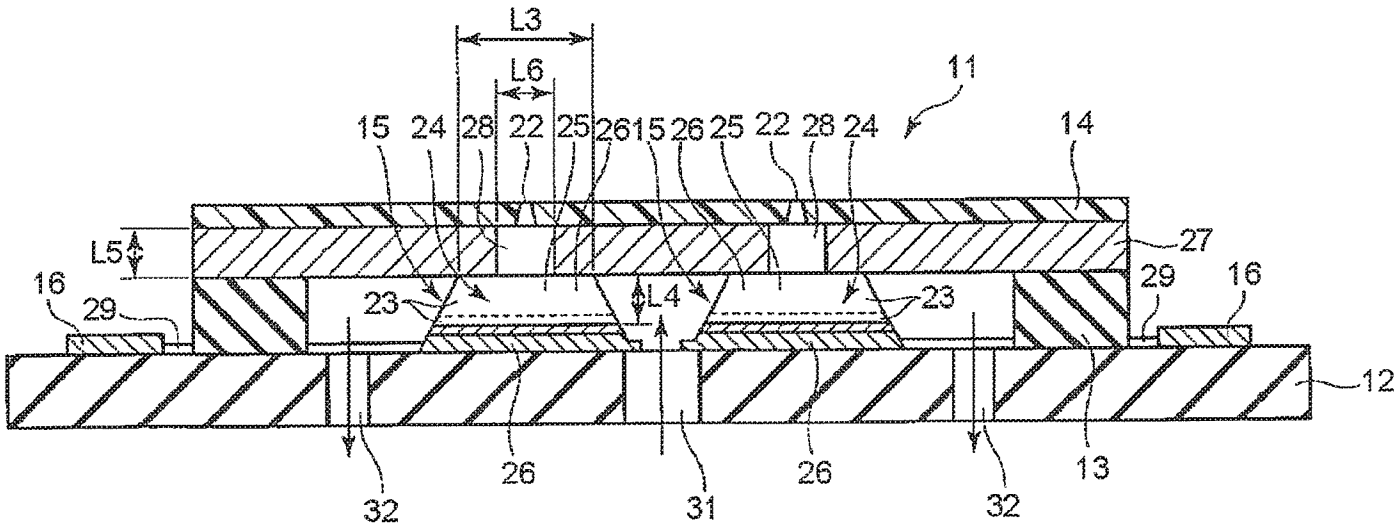
FIG. 2 is a cross-sectional view obtained by cutting at a position of a line F2-F2 shown in FIG. 1.

The first embodiment of the present invention is described with reference to FIG. 1-FIG. 5. An inkjet head 11 according to the present embodiment is an ink circulation type inkjet head of a so called share mode share wall type, and has a structure called as a side shooter type. As shown in FIG. 1 and FIG. 2, the inkjet head 11 includes a substrate 12, a frame member 13 adhered to the substrate 12, a nozzle plate 14 adhered to the frame member 13, a piezoelectric member 15 adhered to the substrate 12 at a position inside the frame member 13 and a head drive IC 16 for driving the piezoelectric member 15.

The nozzle plate 14 formed by a square-shaped polyimide film includes a pair of nozzle arrays 21. Each nozzle array 21 includes a plurality of nozzles 22.

The piezoelectric member 15 is formed by binding two piezoelectric plates 23 which are made of, for example, PZT (lead zirconate titanate) in such a manner that the polarization directions thereof are opposite. The piezoelectric member 15, which is trapezoidal, is formed into a rod-shape. The piezoelectric member 15 includes a plurality of pressure chambers 24 formed by grooves cut in the surface, pillar sections 25 serving as driving elements arranged at two sides of each pressure chamber 24 and electrodes 26 formed at the lateral sides of each pillar section 25 and the bottom of the pressure chamber 24.

The nozzle plate 14 is adhered to the pillar sections 25 of the piezoelectric member 15 across a lid section 27 including a strong, rigid material such as metal, ceramics and the like. The piezoelectric member 15 is adhered to the substrate 12 in such a manner that it corresponds to the nozzle arrays 21 on the nozzle plate 14. The pressure chambers 24 and the pillar sections 25 are formed corresponding to the nozzles 22.

Further, through holes 28 connected to each pressure chamber 24 are formed in the lid section 27. The nozzles 22 of the nozzle plate 14 are opened in a state of being connected to each through hole 28. A plurality of electrical wiring 29 is arranged on the substrate 12. One end of each electrical wiring 29 is connected with the electrode 26 and the other end is connected with the head drive IC 16.

The substrate 12 is formed by, for example, ceramic such as alumina and the like into a square-shaped plate. The substrate 12 includes supply ports 31 and discharge ports 32 which are formed by holes. The supply port 31 is connected with an ink tank of a printer (not shown), and the discharge port 32 is connected with an ink tank (not shown). During the operation of the inkjet head 11, the ink supply is carried out through the supply port 31, and the ink flowing out from the ink tank is filled into the pressure chamber 24 via the supply port 31. The ink that is not used in the pressure chamber 24 is collected to the ink tank through the discharge port 32. The inkjet head 11 according to the present embodiment is a circulation type head which can circulate the ink in the pressure chamber 24 and remove the entrained air bubbles automatically.

Figure 3:
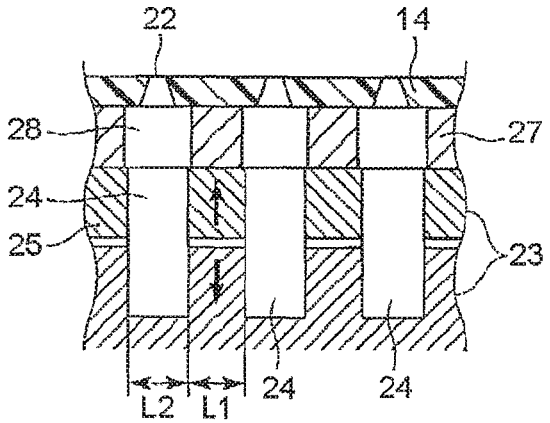
FIG. 3 is a diagram illustrating the operation of the inkjet head according to the first embodiment, (A) is a longitudinal section view illustrating the main portions of the components around a pressure chamber, (B) is a longitudinal section view illustrating the main portions in a state in which the pressure chamber is depressurized, and (C) is a longitudinal section view illustrating the main portions in a state in which the pressure chamber is pressurized to eject ink.
Figure 3:
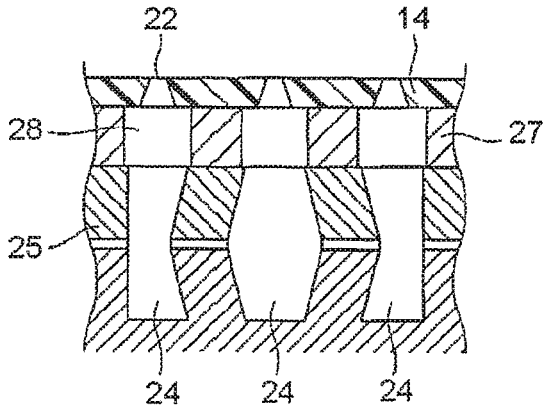
Figure 3:
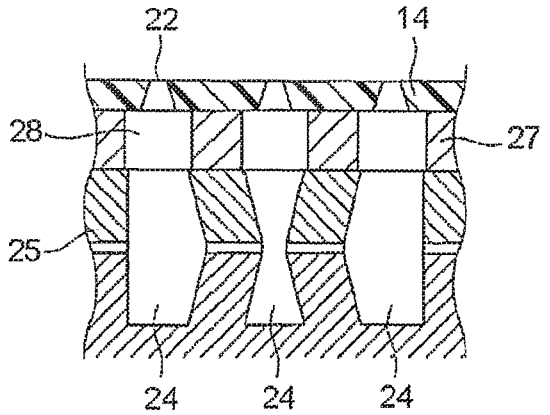

The operation of the inkjet head 11 is described with reference to FIG. 3 (A)~(C). FIG. 3 (A) is a longitudinal section view illustrating the main portions of the components around the pressure chamber 24, FIG. 3 (B) is a longitudinal section view illustrating the main portions in a state in which the pressure chamber 24 is depressurized (a state in which the pressure chamber 24 is enlarged), and FIG. 3 (C) is a longitudinal section view illustrating the main portions in a state in which the pressure chamber 24 is pressurized to eject ink (a state in which the pressure chamber 24 is contracted). When a user instructs the printer to carry out printing, the control section of the printer outputs a print signal to the head drive IC 16 of the inkjet head 11. After the print signal is received, the head drive IC 16 applies a driving pulse voltage to the pillar section 25 through the electrical wiring 29. In this way, the pair of pillar sections 25 at two sides is deformed (curved) into a "<" shape in opposite directions by performing shear mode deformation. At this time, as shown in FIG. 3 (B), the pressure chamber 24 is depressurized (enlarged). Then, as shown in FIG. 3 (C), these are returned to an initial position and the pressure in the pressure chamber 24 is increased (pressure chamber 24 is contracted). In this way, the ink in the pressure chamber 24 is supplied to the nozzle 22 of the nozzle plate 14 via the through hole 28 of the lid section 27, and the ink drops are ejected from the nozzle 22 vigorously.

In such an inkjet head 11, the lid section 27 constitutes one wall surface of the pressure chamber 24, which brings influences on the rigidity of the pressure chamber 24. The higher the rigidity of the lid section 27 is (that is, the more rigid/thick the lid section 27 is), the higher the rigidity of the pressure chamber 24 is; thus, the pressure generated in the piezoelectric member 15 is used efficiently in the ink ejection, and the pressure transmission speed in the ink is increased, and the high-speed driving can be carried out. Herein, it is necessary to arrange openings of through holes 28 connected to the nozzles 22 in the lid section 27, thus, if the thickness of the lid section 27 is too thick, the fluid resistance until the nozzles 22 is increased, which decreases the ejection efficiency. On the contrary, if the openings of the through holes 28 of the lid section 27 are enlarged to avoid the decrease in the ejection efficiency, the rigidity of the pressure chamber 24 is decreased, and the pressure chamber 24 is also increased, which leads to a decrease in the pressure transmission speed. Thus, it is considered that there is an optimum value for the thickness of the lid section 27 and the size of the through hole 28.

Figure 4:
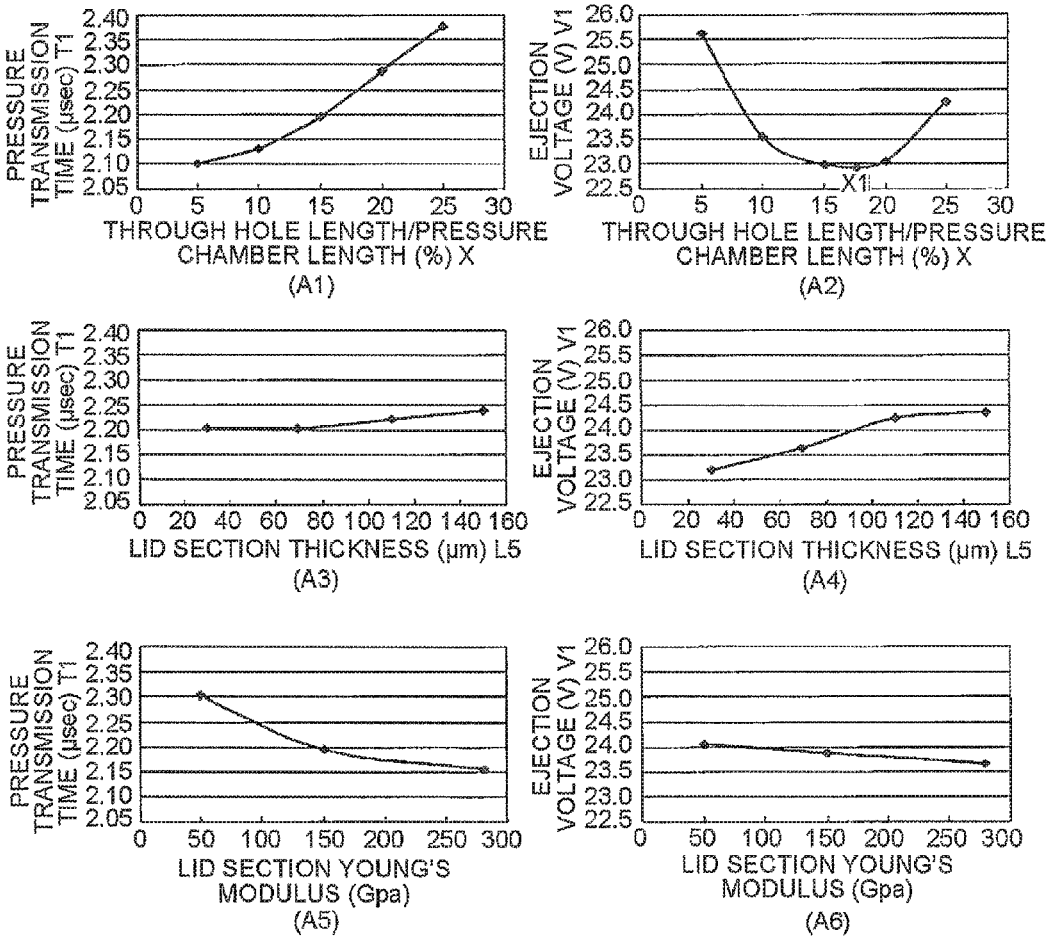
FIG. 4 is a characteristic diagram illustrating results of a test for evaluating ejection voltage and pressure transmission time in a case in which a pressure chamber density is 150 dpi in a case in which the inkjet head according to the first embodiment is prototyped by reference to a table 1.
Figure 5:
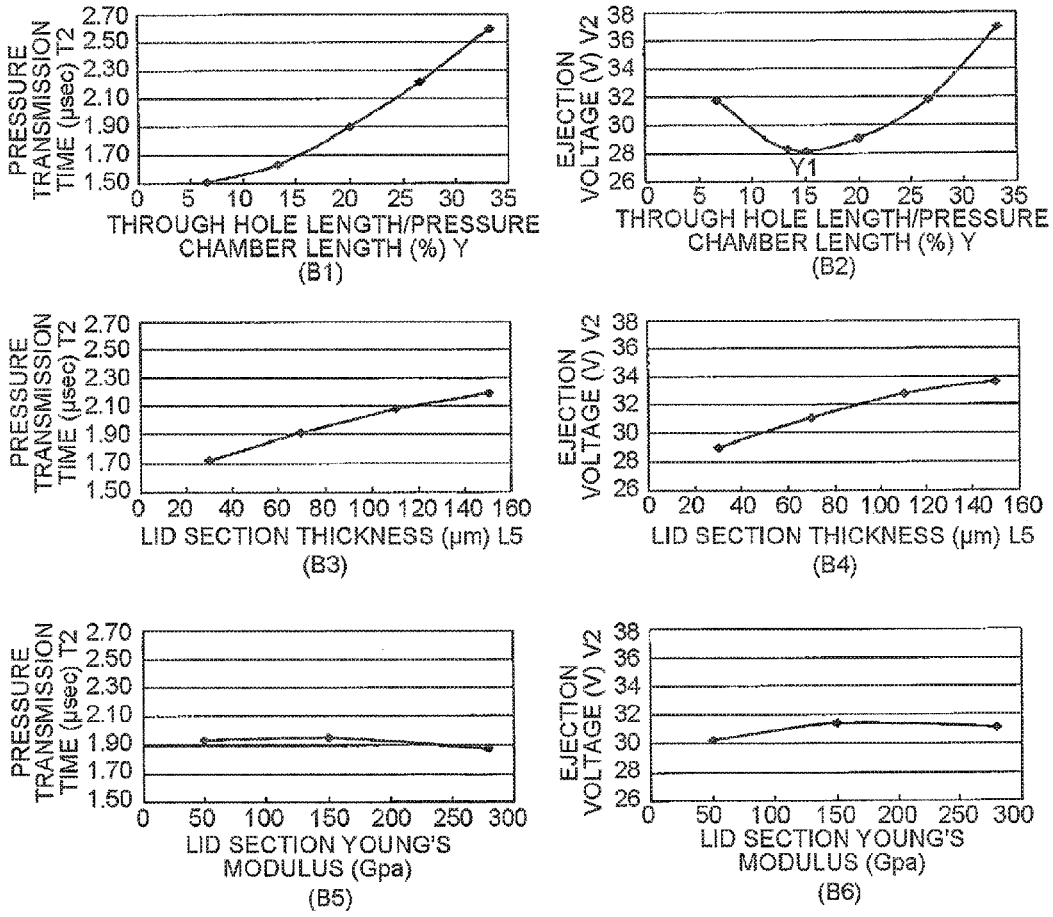
FIG. 5 is a characteristic diagram illustrating results of a test for evaluating ejection voltage and pressure transmission time in a case in which a pressure chamber density is 300 dpi in a case in which the inkjet head according to the first embodiment is prototyped by reference to a table 1.

The inkjet head 11 according to the present embodiment has a length ratio (referred to as a minimum value X1 shown in FIG. 4 (A2) and a minimum value Y1 shown in FIG. 5 (B2)) in a range of 10-25%, such that the relation between the ejection voltage of the ink ejected from the nozzles 22 and a length ratio between the length (refer to L6 shown in FIG. 2) of the through hole 28 of the lid section 27 in the longitudinal direction of the pressure chamber 24 and the length (refer to L3 shown in FIG. 2) of the pressure chamber 24 in the longitudinal direction of the pressure chamber 24 is minimized.

(Prototype of Inkjet Head 11)

The inkjet head 11 is prototyped by reference to the following table 1.

TABLE 1

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 1 | 155 | 80 | 2000 | 300 | 50 | 30 | 100 |
| 2 | | | | | | | 200 |
| 3 | | | | | | | 300 |
| 4 | | | | | | | 400 |
| 5 | | | | | | | 500 |
| 6 | | | | | | 70 | 100 |
| 7 | | | | | | | 200 |
| 8 | | | | | | | 300 |
| 9 | | | | | | | 400 |
| 10 | | | | | | | 500 |
| 11 | | | | | | 110 | 100 |
| 12 | | | | | | | 200 |
| 13 | | | | | | | 300 |
| 14 | | | | | | | 400 |
| 15 | | | | | | | 500 |
| 16 | | | | | | 150 | 100 |
| 17 | | | | | | | 200 |
| 18 | | | | | | | 300 |
| 19 | | | | | | | 400 |
| 20 | | | | | | | 500 |
| 21 | | | | | 150 | 30 | 100 |
| 22 | | | | | | | 200 |
| 23 | | | | | | | 300 |
| 24 | | | | | | | 400 |
| 25 | | | | | | | 500 |
| 26 | | | | | | 70 | 100 |
| 27 | | | | | | | 200 |
| 28 | | | | | | | 300 |
| 29 | | | | | | | 400 |
| 30 | | | | | | | 500 |
| 31 | | | | | | 110 | 100 |
| 32 | | | | | | | 200 |
| 33 | | | | | | | 300 |
| 34 | | | | | | | 400 |
| 35 | | | | | | | 500 |
| 36 | | | | | | 150 | 100 |
| 37 | | | | | | | 200 |
| 38 | | | | | | | 300 |
| 39 | | | | | | | 400 |
| 40 | | | | | | | 500 |
| 41 | | | | | 250 | 30 | 100 |
| 42 | | | | | | | 200 |
| 43 | | | | | | | 300 |
| 44 | | | | | | | 400 |
| 45 | | | | | | | 500 |
| 46 | | | | | | 70 | 100 |
| 47 | | | | | | | 200 |
| 48 | | | | | | | 300 |
| 49 | | | | | | | 400 |
| 50 | | | | | | | 500 |
| 51 | | | | | | 110 | 100 |
| 52 | | | | | | | 200 |
| 53 | | | | | | | 300 |
| 54 | | | | | | | 400 |
| 55 | | | | | | | 500 |
| 56 | | | | | | 150 | 100 |
| 57 | | | | | | | 200 |
| 58 | | | | | | | 300 |
| 59 | | | | | | | 400 |
| 60 | | | | | | | 500 |
| 61 | 64.5 | 40 | 1500 | 150 | 50 | 30 | 100 |
| 62 | | | | | | | 200 |
| 63 | | | | | | | 300 |
| 64 | | | | | | | 400 |
| 65 | | | | | | | 500 |
| 66 | | | | | | 70 | 100 |
| 67 | | | | | | | 200 |
| 68 | | | | | | | 300 |
| 69 | | | | | | | 400 |
| 70 | | | | | | | 500 |
| 71 | | | | | | 110 | 100 |
| 72 | | | | | | | 200 |
| 73 | | | | | | | 300 |

TABLE 1-continued

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 74 | | | | | | | 400 |
| 75 | | | | | | | 500 |
| 76 | | | | | | 150 | 100 |
| 77 | | | | | | | 200 |
| 78 | | | | | | | 300 |
| 79 | | | | | | | 400 |
| 80 | | | | | | | 500 |
| 81 | | | | | 150 | 30 | 100 |
| 82 | | | | | | | 200 |
| 83 | | | | | | | 300 |
| 84 | | | | | | | 400 |
| 85 | | | | | | | 500 |
| 86 | | | | | | 70 | 100 |
| 87 | | | | | | | 200 |
| 88 | | | | | | | 300 |
| 89 | | | | | | | 400 |
| 90 | | | | | | | 500 |
| 91 | | | | | | 110 | 100 |
| 92 | | | | | | | 200 |
| 93 | | | | | | | 300 |
| 94 | | | | | | | 400 |
| 95 | | | | | | | 500 |
| 96 | | | | | | 150 | 100 |
| 97 | | | | | | | 200 |
| 98 | | | | | | | 300 |
| 99 | | | | | | | 400 |
| 100 | | | | | | | 500 |
| 101 | | | | | 250 | 30 | 100 |
| 102 | | | | | | | 200 |
| 103 | | | | | | | 300 |
| 104 | | | | | | | 400 |
| 105 | | | | | | | 500 |
| 106 | | | | | | 70 | 100 |
| 107 | | | | | | | 200 |
| 108 | | | | | | | 300 |
| 109 | | | | | | | 400 |
| 110 | | | | | | | 500 |
| 111 | | | | | | 110 | 100 |
| 112 | | | | | | | 200 |
| 113 | | | | | | | 300 |
| 114 | | | | | | | 400 |
| 115 | | | | | | | 500 |
| 116 | | | | | | 150 | 100 |
| 117 | | | | | | | 200 |
| 118 | | | | | | | 300 |
| 119 | | | | | | | 400 |
| 120 | | | | | | | 500 |

The head 11 is broadly classified into two categories, and two representative categories of heads, that is, one with a pressure chamber density of 150 dpi and one with a pressure chamber density of 300 dpi, are prototyped. In the table 1, as to the pressure chambers 24 in samples No. 1~60, the pitch (L1) is 169 μm, the width (L2) is 80 μm, the length (L3) is 2000 μm, and the depth (L4) is 300 μm. As to the pressure chambers 24 in samples No. 61~120, the pitch (L1) is 84.5 μm, the width (L2) is 40 μm, the length (L3) is 1500 μm, and the depth (L4) is 150 μm. Further, the Young's modulus (Gpa), the thickness (L5) and the opening length (L6) of the through hole 28 of the lid section 27 are set as shown in the table 1. The material of the lid section 27 may be PZT of which the Young's modulus is about 50 GPa, Ni—Fe alloy (42Alloy) of which the Young's modulus is about 150 GPa and 92alumina of which the Young's modulus is about 250 GPa; and the width of the through hole 28 of the lid section 27 is approximately equal to the width (L2) of the pressure chamber 24.

(Test)

The ejection voltage (the voltage required to eject a certain amount of ink drops at a predetermined driving speed) and the pressure transmission time (the time the pressure transmits in the pressure chamber; in inverse proportion to the pressure transmission speed) are evaluated for each inkjet head 11 shown in the samples No. 1~120. The test results are as shown in the following table 2.

TABLE 2

| NO. | PRESSURE TRANS-MISSION TIME (μsec) | 6 pl EJECTION VOLTAGE (V) | NO. | PRESSURE TRANS-MISSION TIME (μsec) | 4 pl EJECTION VOLTAGE (V) |
|---|---|---|---|---|---|
| 1 | 2.180 | 23.3 | 61 | 1.546 | 28.9 |
| 2 | 2.209 | 23.2 | 62 | 1.613 | 28.0 |
| 3 | 2.251 | 22.9 | 63 | 1.722 | 27.4 |
| 4 | 2.286 | 23.0 | 64 | 1.799 | 28.3 |
| 5 | 2.356 | 24.2 | 65 | 2.179 | 33.5 |

TABLE 2-continued

| NO. | PRESSURE TRANS-MISSION TIME (μsec) | 6 pl EJECTION VOLTAGE (V) | NO. | PRESSURE TRANS-MISSION TIME (μsec) | 4 pl EJECTION VOLTAGE (V) |
|---|---|---|---|---|---|
| 6 | 2.159 | 25.2 | 66 | 1.585 | 30.8 |
| 7 | 2.199 | 23.4 | 67 | 1.715 | 27.7 |
| 8 | 2.270 | 23.2 | 68 | 1.930 | 29.9 |
| 9 | 2.359 | 23.4 | 69 | 2.222 | 32.2 |
| 10 | 2.449 | 24.6 | 70 | 2.602 | 37.4 |
| 11 | 2.155 | 26.2 | 71 | 1.563 | 33.0 |
| 12 | 2.202 | 23.9 | 72 | 1.785 | 28.4 |
| 13 | 2.297 | 23.0 | 73 | 2.232 | 31.8 |
| 14 | 2.428 | 23.6 | 74 | 2.578 | 35.0 |
| 15 | 2.519 | 24.8 | 75 | 2.258 | 40.2 |
| 16 | 2.158 | 27.7 | 76 | 1.434 | 34.4 |
| 17 | 2.208 | 24.4 | 77 | 1.506 | 26.6 |
| 18 | 2.319 | 23.1 | 78 | 2.430 | 32.2 |
| 19 | 2.480 | 23.7 | 79 | 2.827 | 35.5 |
| 20 | 2.570 | 24.9 | 80 | 3.207 | 41.7 |
| 21 | 2.106 | 24.2 | 81 | 1.485 | 29.8 |
| 22 | 2.132 | 22.7 | 82 | 1.547 | 27.6 |
| 23 | 2.172 | 22.8 | 83 | 1.659 | 27.2 |
| 24 | 2.221 | 22.8 | 84 | 1.729 | 27.8 |
| 25 | 2.311 | 24.0 | 85 | 2.109 | 33.0 |
| 26 | 2.077 | 24.5 | 86 | 1.490 | 31.8 |
| 27 | 2.105 | 23.8 | 87 | 1.581 | 28.5 |
| 28 | 2.163 | 22.9 | 88 | 1.791 | 28.8 |
| 29 | 2.245 | 22.9 | 89 | 2.077 | 30.9 |
| 30 | 2.335 | 24.1 | 90 | 2.457 | 36.1 |
| 31 | 2.070 | 26.8 | 91 | 1.500 | 32.6 |
| 32 | 2.101 | 24.4 | 92 | 1.629 | 28.2 |
| 33 | 2.171 | 23.2 | 93 | 1.977 | 29.4 |
| 34 | 2.277 | 23.3 | 94 | 2.406 | 32.6 |
| 35 | 2.357 | 24.5 | 95 | 2.785 | 37.8 |
| 36 | 2.073 | 27.6 | 96 | 1.508 | 33.8 |
| 37 | 2.105 | 23.8 | 97 | 1.680 | 28.5 |
| 38 | 2.152 | 23.0 | 98 | 2.061 | 30.1 |
| 39 | 2.303 | 22.7 | 99 | 2.575 | 34.5 |
| 40 | 2.393 | 23.9 | 100 | 2.965 | 39.7 |
| 41 | 2.052 | 23.4 | 101 | 1.470 | 28.5 |
| 42 | 2.103 | 22.8 | 102 | 1.524 | 27.5 |
| 43 | 2.141 | 22.5 | 103 | 1.612 | 26.8 |
| 44 | 2.190 | 22.5 | 104 | 1.721 | 27.7 |
| 45 | 2.250 | 23.7 | 105 | 2.101 | 32.8 |
| 46 | 2.050 | 24.4 | 106 | 1.480 | 30.4 |
| 47 | 2.073 | 23.1 | 107 | 1.538 | 28.1 |
| 48 | 2.124 | 22.7 | 108 | 1.725 | 28.0 |
| 49 | 2.198 | 22.8 | 109 | 2.060 | 30.3 |
| 50 | 2.288 | 24.0 | 110 | 2.440 | 35.5 |
| 51 | 2.045 | 26.6 | 111 | 1.490 | 33.8 |
| 52 | 2.070 | 23.2 | 112 | 1.578 | 29.0 |
| 53 | 2.128 | 23.2 | 113 | 1.508 | 29.1 |
| 54 | 2.219 | 23.2 | 114 | 2.231 | 32.7 |
| 55 | 2.309 | 24.4 | 115 | 2.611 | 37.9 |
| 56 | 2.049 | 27.5 | 116 | 1.498 | 33.8 |
| 57 | 2.075 | 23.6 | 117 | 1.606 | 29.6 |
| 58 | 2.138 | 23.4 | 118 | 1.592 | 29.1 |
| 59 | 2.238 | 22.6 | 119 | 2.426 | 33.4 |
| 60 | 2.329 | 23.5 | 120 | 2.506 | 35.6 |

Further, the result totalized for each parameter of the lid section 27 is as shown in the following FIG. 4 and FIG. 5. FIG. 4 is a characteristic diagram illustrating the result of the test for evaluating the ejection voltage V1 (V) and the pressure transmission time T1 (μsec) in a case in which the pressure chamber density is 150 dpi. FIG. 4 (A1) is a characteristic diagram illustrating the relation between T1 and the length ratio X (%) between the length L6 of the through hole 28 of the lid section 27 in the longitudinal direction of the pressure chamber 24 and the length L3 of the pressure chamber 24 in the longitudinal direction of the pressure chamber 24. FIG. 4 (A2) is a characteristic diagram illustrating the relation between the ejection voltage V1 and X. FIG. 4 (A3) is a characteristic diagram illustrating the relation between T1 and the thickness L5 of the lid section 27. FIG. 4 (A4) is a characteristic diagram illustrating the relation between the ejection voltage V1 and L5. FIG. 4 (A5) is a characteristic diagram illustrating the relation between T1 and the Young's modulus of the lid section 27. FIG. 4 (A6) is a characteristic diagram illustrating the relation between the ejection voltage V1 and the Young's modulus of the lid section 27.

FIG. 5 is a characteristic diagram illustrating the result of the test for evaluating the ejection voltage V2 (V) and the pressure transmission time T2 (μsec) in a case in which the pressure chamber density is 300 dpi. FIG. 5 (B1) is a characteristic diagram illustrating the relation between T2 and the length ratio Y (%) between the length L6 of the through hole 28 of the lid section 27 in the longitudinal direction of the pressure chamber 24 and the length L3 of the pressure chamber 24 in the longitudinal direction of the pressure chamber 24. FIG. 5 (B2) is a characteristic diagram illustrating the relation between the ejection voltage V2 and Y. FIG. 5 (B3) is a characteristic diagram illustrating the relation between T2 and the thickness L5 of the lid section 27. FIG. 5 (B4) is a characteristic diagram illustrating the relation between the ejection voltage V2 and L5. FIG. 5 (B5) is a characteristic diagram illustrating the relation between T2 and the Young's modulus of the lid section 27. FIG. 5 (B6) is a characteristic diagram illustrating the relation between the ejection voltage V2 and the Young's modulus of the lid section 27.

(Effect)

It can be known from each characteristic diagram shown in FIG. 4 and FIG. 5 that the parameter which has the most influences on the characteristic is the length L6 of the through hole 28 of the lid section 27 in the longitudinal direction of the pressure chamber 24, and that both of the two categories of inkjet heads 11 are used suitably in the range in which the length ratios X and Y of the pressure chamber 24 are 10~25%.

The thinner the thickness (L5) of the lid section 27 is, the better; however, the thickness (L5) of the lid section 27 has less influence on the characteristic compared with the length (L6) of the through hole 28, thus, the lid section 27 may be appropriately manufactured with the handling property, the manufacturability or the cost and the like taken into consideration. The higher the Young's modulus of the lid section 27 is (that is, the firmer the lid section 27 is), the better; however, viewing from the perspective of manufacturability, the manufacturing process becomes more difficult if the lid section 27 is too firm, thus, the Young's modulus of the lid section 27 is preferred to be about 150 GPa.

Moreover, since various kinds of ink are used in the inkjet head 11, thus, the lid section 27 is adhered by thermosetting adhesive in consideration of ink resistance. Thus, the warping of the head 11 is reduced if the coefficient of thermal expansion of the lid section 27 is approximate to that of the piezoelectric member 15. Even if the lid section 27 can be adhered by room temperature curing adhesive, the ink with low viscosity is ejected because of the high temperature when the head 11 is being used. Thus, it is preferred that the coefficient of thermal expansion of the lid section 27 is approximate to that of the piezoelectric member 15, thus, 42Alloy, invar, kovar and the like are preferred.

In addition, in a case in which the lid section 27 is made of these conductive materials, as the lid section 27 is contacted with the electrode 26 of the pressure chamber 24 across the adhesive, thus, an insulating thin film such as $SiO_2$ and the like is formed at the contacting surface.

Thus, the inkjet head 11 with the constitution described above has the following effects. That is, in the inkjet head 11, within each parameter of the thickness (L5), the Young's modulus and the opening length (L6) of the through hole 28 of the lid section 27, the parameter of the opening length (L6) of the through hole 28 has the most influences on the characteristic of the inkjet head 11. The inkjet head 11 according to the present embodiment is set in a range of 10~25% before and after the center, that is, the length ratio (refer to X1 shown in FIG. 4 (A2) and Y1 shown in FIG. 5 (B2)) where the relation between the ejection voltage of the ink ejected from the nozzles 22 and the length ratio between the length (refer to L6 shown in FIG. 2) of the through hole 28 of the lid section 27 in the longitudinal direction of the pressure chamber 24 and the length (refer to L3 shown in FIG. 2) of the pressure chamber 24 in the longitudinal direction of the pressure chamber 24 is minimized. In this way, the opening length (L6) of the through hole 28 is optimized to improve the ink ejection efficiency, reduce the drive voltage, and to increase the drive frequency.

In accordance with the embodiment described above, there can be provided an inkjet printer head capable of optimizing the ejection efficiency.

Further, it is also applicable to arrange the electrode 26 up to half without laminating the piezoelectric member 15.

A Second Embodiment

Constitution

Figure 6:
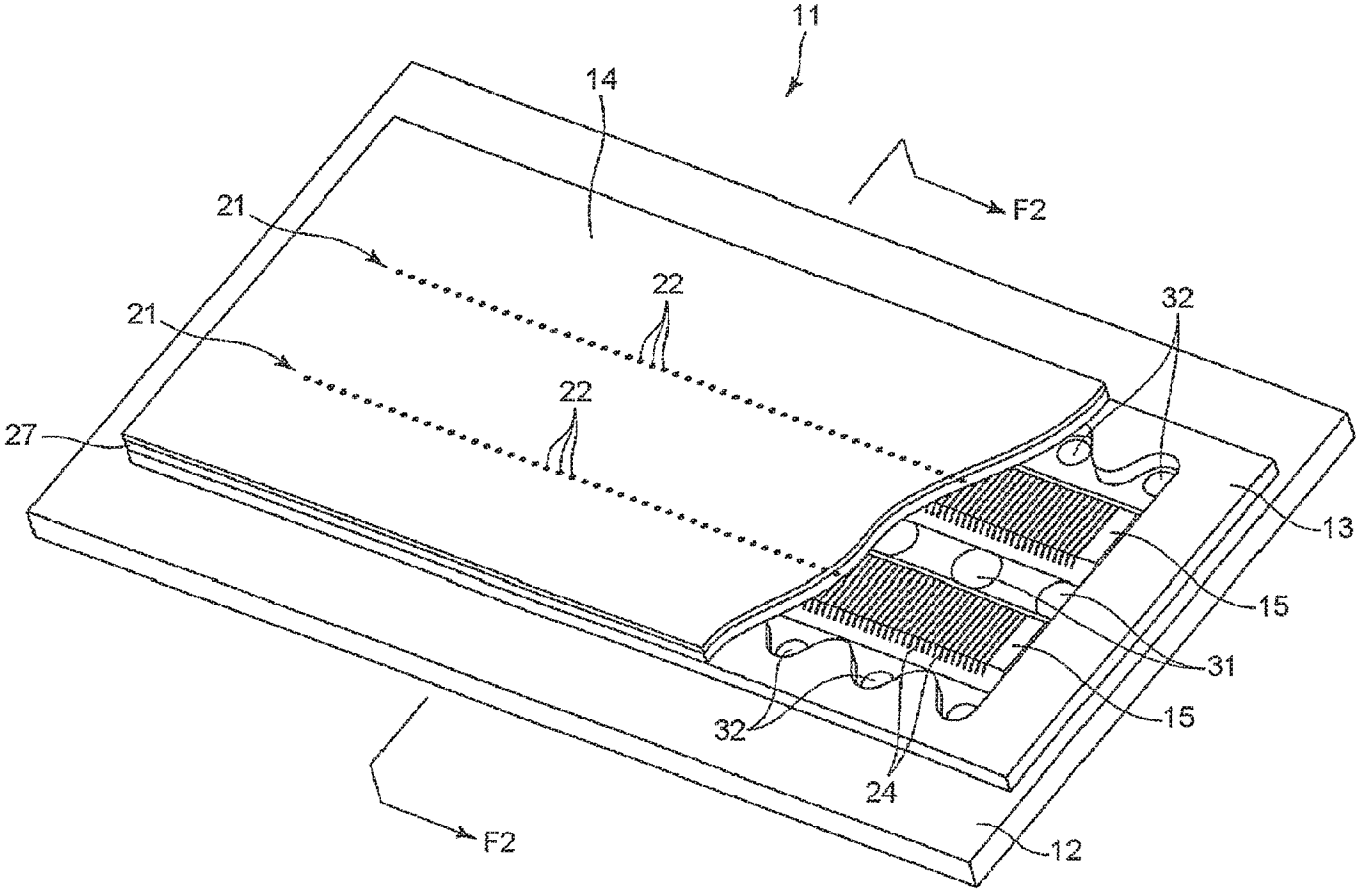
FIG. 6 is a perspective view of an inkjet head according to a second embodiment in which one part of the inkjet head is broken.
Figure 7:
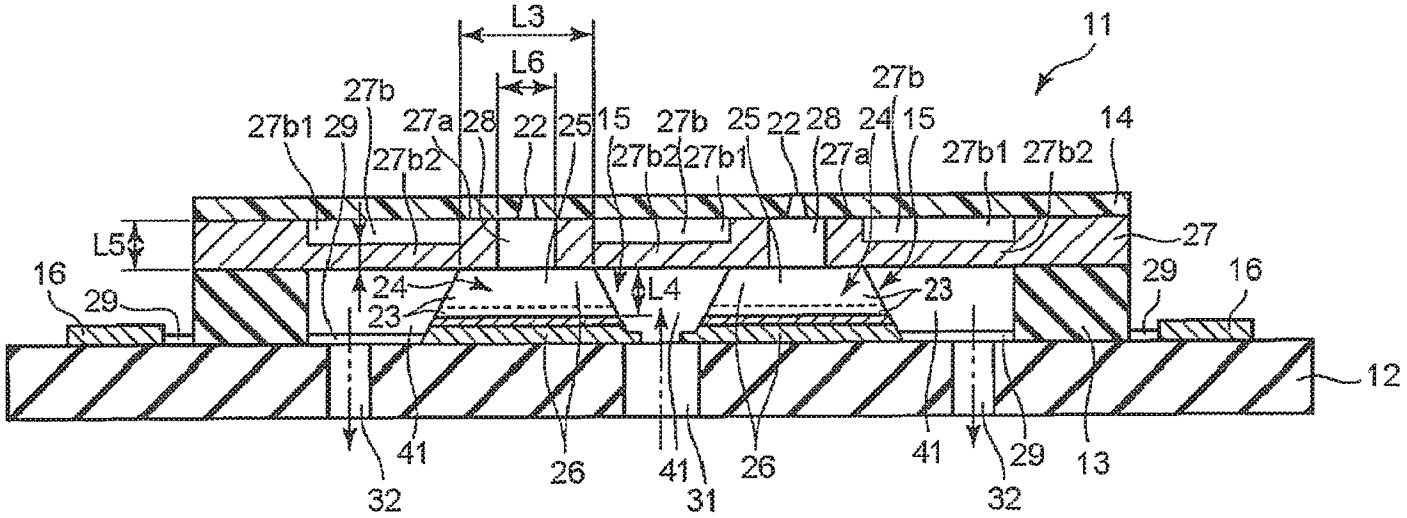
FIG. 7 is a cross-sectional view obtained by cutting at a position of a line F2-F2 shown in FIG. 6.

The second embodiment of the present invention is described with reference to FIG. 6-FIG. 10. The same components as those described in the first embodiment are indicated by the same reference numerals in the drawings. The inkjet head 11 according to the present embodiment is an ink circulation type inkjet head of a so called share mode share wall type, and has a structure called as a side shooter type. As shown in FIG. 6 and FIG. 7, the inkjet head 11 includes a substrate 12, a frame member 13 adhered to the substrate 12, a nozzle plate 14 adhered to the frame member 13, a piezoelectric member 15 adhered to the substrate 12 at a position inside the frame member 13 and a head drive IC 16 for driving the piezoelectric member 15.

The nozzle plate 14, which is a resin material having a thickness of 25~75 μm, is formed by, for example, a square-shaped polyimide film. The nozzle plate 14 includes a pair of nozzle arrays 21. Each nozzle array 21 includes a plurality of nozzles 22.

The piezoelectric member 15 is formed by binding two piezoelectric plates 23 which are made of, for example, PZT (lead zirconate titanate) in such a manner that the polarization directions thereof are opposite. The piezoelectric member 15, which is trapezoidal, is formed into a rod-shape. The piezoelectric member 15 includes a plurality of pressure chambers 24 formed by grooves cut in the surface, pillar sections 25 serving as driving elements arranged at two sides of each pressure chamber 24 and electrodes 26 formed at the lateral sides of each pillar section 25 and the bottom of the pressure chamber 24.

The nozzle plate 14 is adhered to the pillar sections 25 of the piezoelectric member 15 across a lid section 27 including a strong, rigid material such as metal, ceramics and the like. The piezoelectric member 15 is adhered to the substrate 12 in such a manner that it corresponds to the nozzle arrays 21 on the nozzle plate 14. The pressure chambers 24 and the pillar sections 25 are formed corresponding to the nozzles 22.

Further, through holes 28 connected to each pressure chamber 24 are formed in the lid section 27. In the present embodiment, the Young's modulus of the lid section 27 is set to 100~200 Gpa. Further, the lid section 27 according to the present embodiment includes a first part 27*a* which covers the pressure chamber 24 and a second part 27*b* which covers a common liquid chamber 41 between the pressure chambers 24. The thickness of the first part 27*a* is set to 30~60 μm, and the second part 27*b* includes a thin part 27*b*2 of which the thickness is thinner than that of the first part 27*a*. In the present embodiment, the thin part 27*b*2 of the second part 27*b* is set to be half as thick as the first part 27*a*.

The nozzles 22 of the nozzle plate 14 are opened in a state of being connected to each through hole 28. A plurality of electrical wiring 29 is arranged on the substrate 12. One end of each electrical wiring 29 is connected with the electrode 26 and the other end is connected with the head drive IC 16.

The substrate 12 is formed by, for example, ceramic such as alumina and the like into a square-shaped plate. The substrate 12 includes supply ports 31 and discharge ports 32 which are formed by holes. The supply port 31 is connected with an ink tank of a printer (not shown), and the discharge port 32 is connected with an ink tank (not shown). During the operation of the inkjet head 11, the ink supply is carried out through the supply port 31, and the ink flowing out from the ink tank is filled into the pressure chamber 24 via the supply port 31. The ink that is not used in the pressure chamber 24 is collected to the ink tank through the discharge port 32. The inkjet head 11 according to the present embodiment is a circulation type head which can circulate the ink in the pressure chamber 24 and remove the entrained air bubbles automatically.

Figure 8:
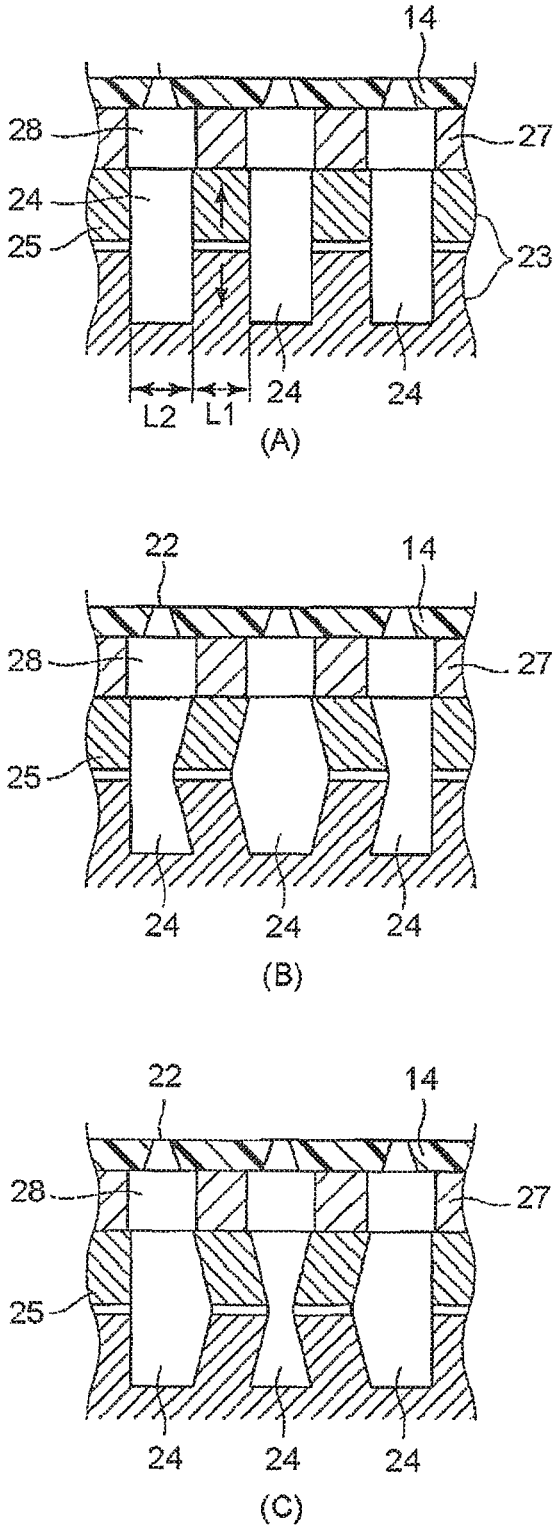
FIG. 8 is a diagram illustrating the operation of the inkjet head according to the second embodiment, (A) is a longitudinal section view illustrating the main portions of the components around a pressure chamber, (B) is a longitudinal section view illustrating the main portions in a state in which the pressure chamber is depressurized, and (C) is a longitudinal section view illustrating the main portions in a state in which the pressure chamber is pressurized to eject ink.

The operation of the inkjet head 11 is described with reference to FIG. 8 (A)~(C). FIG. 8 (A) is a longitudinal section view illustrating the main portions of the components around the pressure chamber 24, FIG. 8 (B) is a longitudinal section view illustrating the main portions in a state in which the pressure chamber 24 is depressurized (a state in which the pressure chamber 24 is enlarged), and FIG. 8 (C) is a longitudinal section view illustrating the main portions in a state in which the pressure chamber 24 is pressurized to eject ink (a state in which the pressure chamber 24 is contracted). When a user instructs the printer to carry out printing, the control section of the printer outputs a print signal to the head drive IC 16 of the inkjet head 11. After the print signal is received, the head drive IC 16 applies a driving pulse voltage to the pillar section 25 through the electrical wiring 29. In this way, the pair of pillar sections 25 at two sides is deformed (curved) into a "<" shape in opposite directions by performing shear mode deformation. At this time, as shown in FIG. 8 (B), the pressure chamber 24 is depressurized (enlarged). Then, as shown in FIG. 8 (C), these are returned to an initial position and the pressure in the pressure chamber 24 is increased (pressure chamber 24 is contracted). In this way, the ink in the pressure chamber 24 is supplied to the nozzle 22 of the nozzle plate 14 via the through hole 28 of the lid section 27, and the ink drops are ejected from the nozzle 22 vigorously.

In such an inkjet head 11, the lid section 27 constitutes one wall surface of the pressure chamber 24, which brings influences on the rigidity of the pressure chamber 24. The higher the rigidity of the lid section 27 is (that is, the more rigid/thick the lid section 27 is), the higher the rigidity of the pressure chamber 24 is; thus, the pressure generated in the piezoelectric member 15 is used efficiently in the ink ejection, and the pressure transmission speed in the ink is increased, and the high-speed driving can be carried out. Herein, it is necessary to arrange openings of through holes 28 connected to the nozzles 22 in the lid section 27, thus, if the thickness of the lid section 27 is too thick, the fluid resistance until the nozzles 22 is increased, which decreases the ejection efficiency. On the contrary, if the openings of the through holes 28 of the lid section 27 are enlarged to avoid the decrease in the ejection efficiency, the rigidity of the pressure chamber 24 is decreased, and the pressure chamber 24 is also increased, which leads to a decrease in the pressure transmission speed. Thus, it is considered that there is an optimum value for the thickness of the lid section 27 and the size of the through hole 28.

Figure 9:
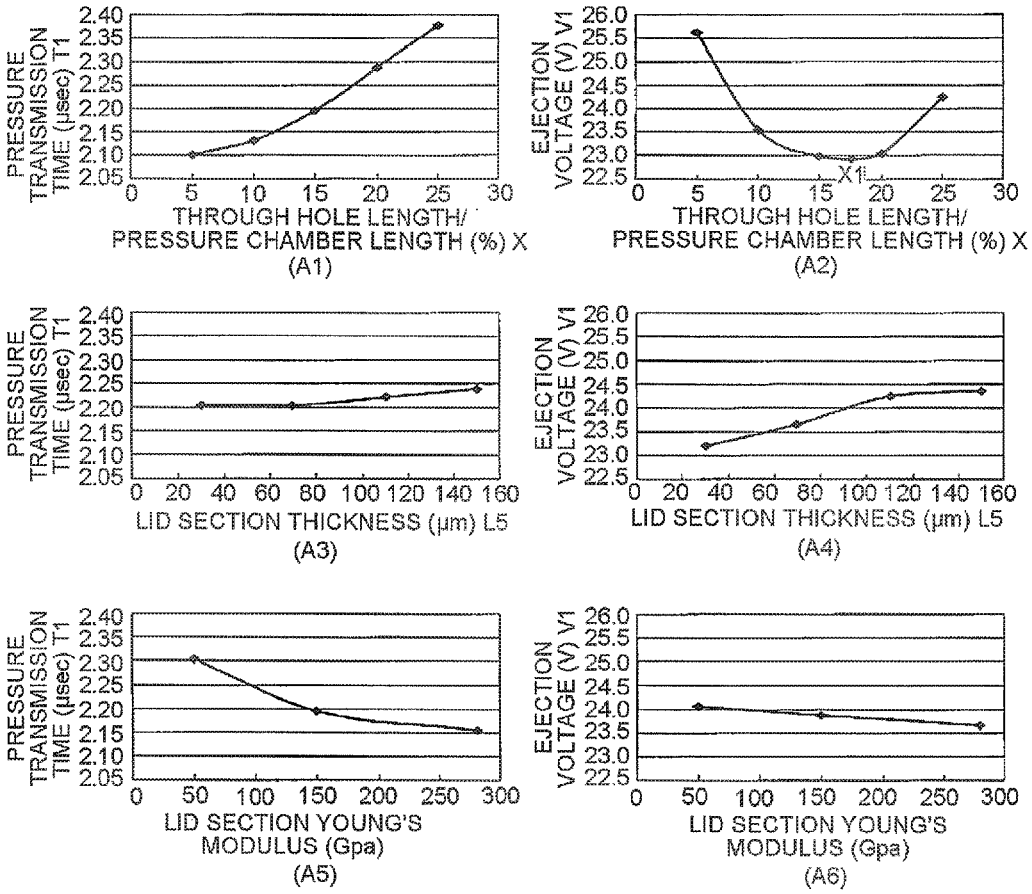
FIG. 9 is a characteristic diagram illustrating results of a test for evaluating ejection voltage and pressure transmission time in a case in which a pressure chamber density is 150 dpi in a case in which the inkjet head according to the second embodiment is prototyped by reference to a table 3.
Figure 10:
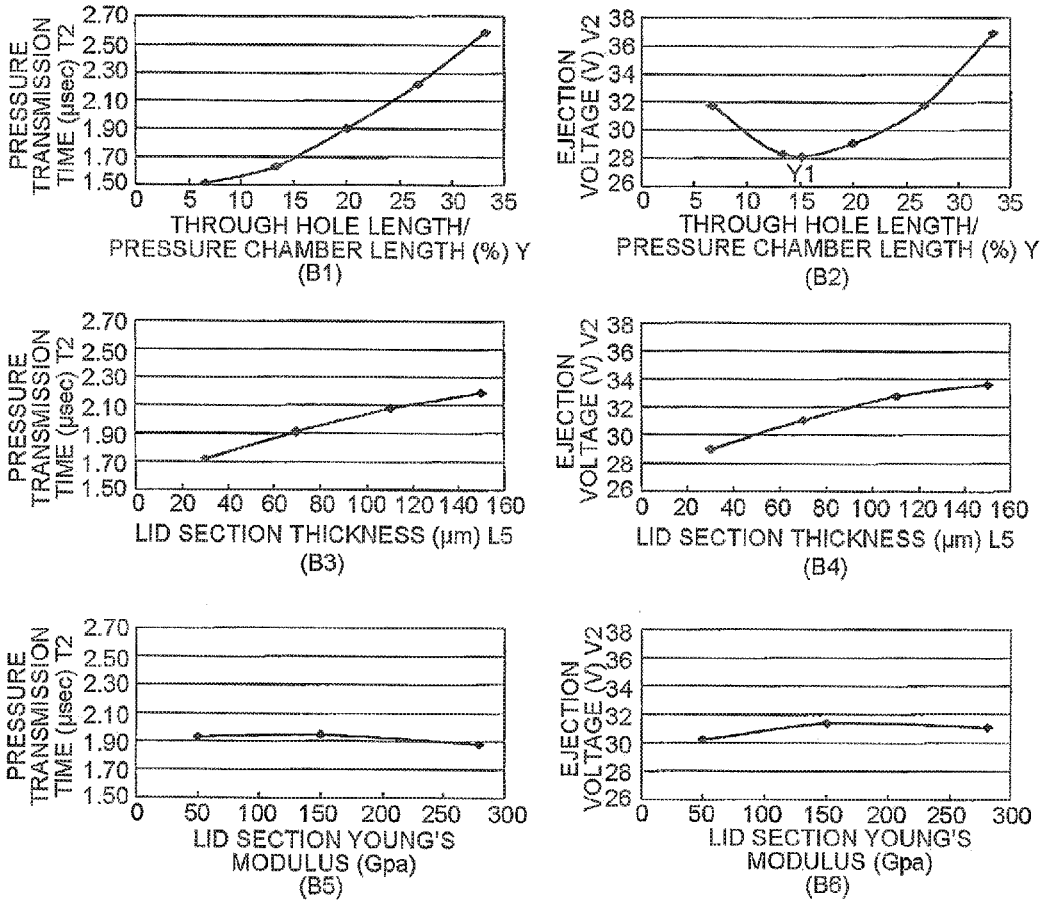
FIG. 10 is a characteristic diagram illustrating results of a test for evaluating ejection voltage and pressure transmission time in a case in which a pressure chamber density is 300 dpi in a case in which the inkjet head according to the second embodiment is prototyped by reference to a table 3.

The inkjet head 11 according to the present embodiment is set in a range of 10~25% before and after a center, that is, a length ratio (refer to a minimum value X1 shown in FIG. 9 (A2) and a minimum value Y1 shown in FIG. 10 (B2)) where the relation between the ejection voltage of the ink ejected from the nozzles 22 and a length ratio between the length (refer to L6 shown in FIG. 7) of the through hole 28 of the lid section 27 in the longitudinal direction of the pressure chamber 24 and the length (refer to L3 shown in FIG. 7) of the pressure chamber 24 in the longitudinal direction of the pressure chamber 24 is minimized.

(Prototype of Inkjet Head 11)

The inkjet head 11 is prototyped by reference to the following table 3.

TABLE 3

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 1 | 169 | 80 | 2000 | 300 | 50 | 30 | 100 |
| 2 | | | | | | | 200 |
| 3 | | | | | | | 300 |
| 4 | | | | | | | 400 |
| 5 | | | | | | | 500 |
| 6 | | | | | | 70 | 100 |
| 7 | | | | | | | 200 |
| 8 | | | | | | | 300 |
| 9 | | | | | | | 400 |
| 10 | | | | | | | 500 |
| 11 | | | | | | 110 | 100 |
| 12 | | | | | | | 200 |
| 13 | | | | | | | 300 |
| 14 | | | | | | | 400 |
| 15 | | | | | | | 500 |
| 16 | | | | | | 150 | 100 |
| 17 | | | | | | | 200 |
| 18 | | | | | | | 300 |
| 19 | | | | | | | 400 |
| 20 | | | | | | | 500 |
| 21 | | | | | 150 | 30 | 100 |
| 22 | | | | | | | 200 |
| 23 | | | | | | | 300 |
| 24 | | | | | | | 400 |
| 25 | | | | | | | 500 |
| 26 | | | | | | 70 | 100 |
| 27 | | | | | | | 200 |
| 28 | | | | | | | 300 |
| 29 | | | | | | | 400 |
| 30 | | | | | | | 500 |
| 31 | | | | | | 110 | 100 |
| 32 | | | | | | | 200 |
| 33 | | | | | | | 300 |
| 34 | | | | | | | 400 |
| 35 | | | | | | | 500 |
| 36 | | | | | | 150 | 100 |
| 37 | | | | | | | 200 |
| 38 | | | | | | | 300 |
| 39 | | | | | | | 400 |
| 40 | | | | | | | 500 |
| 41 | | | | | 250 | 30 | 100 |
| 42 | | | | | | | 200 |
| 43 | | | | | | | 300 |
| 44 | | | | | | | 400 |
| 45 | | | | | | | 500 |
| 46 | | | | | | 70 | 100 |
| 47 | | | | | | | 200 |
| 48 | | | | | | | 300 |
| 49 | | | | | | | 400 |
| 50 | | | | | | | 500 |
| 51 | | | | | | 110 | 100 |
| 52 | | | | | | | 200 |
| 53 | | | | | | | 300 |
| 54 | | | | | | | 400 |
| 55 | | | | | | | 500 |
| 56 | | | | | | 150 | 100 |
| 57 | | | | | | | 200 |

TABLE 3-continued

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 58 | | | | | | | 300 |
| 59 | | | | | | | 400 |
| 60 | | | | | | | 500 |
| 61 | 94.5 | 40 | 1500 | 150 | 50 | 30 | 100 |
| 62 | | | | | | | 200 |
| 63 | | | | | | | 300 |
| 64 | | | | | | | 400 |
| 65 | | | | | | | 500 |
| 66 | | | | | | 70 | 100 |
| 67 | | | | | | | 200 |
| 68 | | | | | | | 300 |
| 69 | | | | | | | 400 |
| 70 | | | | | | | 500 |
| 71 | | | | | | 110 | 100 |
| 72 | | | | | | | 200 |
| 73 | | | | | | | 300 |
| 74 | | | | | | | 400 |
| 75 | | | | | | | 500 |
| 76 | | | | | | 150 | 100 |
| 77 | | | | | | | 200 |
| 78 | | | | | | | 300 |
| 79 | | | | | | | 400 |
| 80 | | | | | | | 500 |
| 81 | | | | | 150 | 30 | 100 |
| 82 | | | | | | | 200 |
| 83 | | | | | | | 300 |
| 84 | | | | | | | 400 |
| 85 | | | | | | | 500 |
| 86 | | | | | | 70 | 100 |
| 87 | | | | | | | 200 |
| 88 | | | | | | | 300 |
| 89 | | | | | | | 400 |
| 90 | | | | | | | 500 |
| 91 | | | | | | 110 | 100 |
| 92 | | | | | | | 200 |
| 93 | | | | | | | 300 |
| 94 | | | | | | | 400 |
| 95 | | | | | | | 500 |
| 96 | | | | | | 150 | 100 |
| 97 | | | | | | | 200 |
| 98 | | | | | | | 300 |
| 99 | | | | | | | 400 |
| 100 | | | | | | | 500 |
| 101 | | | | | 250 | 30 | 100 |
| 102 | | | | | | | 200 |
| 103 | | | | | | | 300 |
| 104 | | | | | | | 400 |
| 105 | | | | | | | 500 |
| 106 | | | | | | 70 | 100 |
| 107 | | | | | | | 200 |
| 108 | | | | | | | 300 |
| 109 | | | | | | | 400 |
| 110 | | | | | | | 500 |
| 111 | | | | | | 110 | 100 |
| 112 | | | | | | | 200 |
| 113 | | | | | | | 300 |
| 114 | | | | | | | 400 |
| 115 | | | | | | | 500 |
| 116 | | | | | | 150 | 100 |
| 117 | | | | | | | 200 |
| 118 | | | | | | | 300 |
| 119 | | | | | | | 400 |
| 120 | | | | | | | 500 |

The head 11 is broadly classified into two categories, and two representative categories of heads, that is, one with a pressure chamber density of 150 dpi and one with a pressure chamber density of 300 dpi, are prototyped. In the table 3, as to the pressure chambers 24 in samples No. 1~60, the pitch (L1) is 169 μm, the width (L2) is 80 μm, the length (L3) is 2000 μm, and the depth (L4) is 300 μm. As to the pressure chambers 24 in samples No. 61~120, the pitch (L1) is 84.5 μm, the width (L2) is 40 μm, the length (L3) is 1500 μm, and the depth (L4) is 150 μm. Further, the Young's modulus (Gpa), the thickness (L5) and the opening length (L6) of the through hole 28 of the lid section 27 are set as shown in the table 3. The material of the lid section 27 may be PZT of which the Young's modulus is about 50 GPa, Ni—Fe alloy (42Alloy) of which the Young's modulus is about 150 GPa and 92alumina of which the Young's modulus is about 250 GPa; and the width of the through hole 28 of the lid section 27 is approximately equal to the width (L2) of the pressure chamber 24.

(Test)

The ejection voltage (the voltage required to eject a certain amount of ink drops at a predetermined driving speed) and the pressure transmission time (the time the pressure transmits in the pressure chamber; in inverse proportion to the pressure transmission speed) are evaluated for each inkjet head 11 shown in the samples No. 1~120. The test results are as shown in the following table 4.

TABLE 4

| NO. | PRESSURE TRANS-MISSION TIME (μsec) | 6 pl EJECTION VOLTAGE (V) | NO. | PRESSURE TRANS-MISSION TIME (μsec) | 4 pl EJECTION VOLTAGE (V) |
|---|---|---|---|---|---|
| 1 | 2.180 | 23.3 | 61 | 1.546 | 28.9 |
| 2 | 2.209 | 23.2 | 62 | 1.613 | 28.0 |
| 3 | 2.251 | 22.9 | 63 | 1.722 | 27.4 |
| 4 | 2.256 | 23.0 | 64 | 1.799 | 28.3 |
| 5 | 2.386 | 24.2 | 65 | 2.179 | 33.5 |
| 6 | 2.159 | 25.2 | 66 | 1.565 | 30.8 |
| 7 | 2.199 | 23.4 | 67 | 1.715 | 27.7 |
| 8 | 2.270 | 23.2 | 68 | 1.980 | 29.9 |
| 9 | 2.359 | 23.4 | 69 | 2.222 | 32.2 |
| 10 | 2.449 | 24.6 | 70 | 2.602 | 37.4 |
| 11 | 2.155 | 26.2 | 71 | 1.563 | 33.0 |
| 12 | 2.202 | 23.9 | 72 | 1.785 | 28.4 |
| 13 | 2.297 | 23.0 | 73 | 2.232 | 31.8 |
| 14 | 2.429 | 23.6 | 74 | 2.578 | 35.0 |
| 15 | 2.519 | 24.8 | 75 | 2.958 | 40.2 |
| 16 | 2.158 | 27.7 | 76 | 1.584 | 34.4 |
| 17 | 2.208 | 24.4 | 77 | 1.506 | 26.6 |
| 18 | 2.319 | 23.1 | 78 | 2.430 | 32.2 |
| 19 | 2.480 | 23.7 | 79 | 2.827 | 36.5 |
| 20 | 2.570 | 24.9 | 80 | 3.207 | 41.7 |
| 21 | 2.106 | 24.2 | 81 | 1.485 | 29.8 |
| 22 | 2.132 | 22.7 | 82 | 1.547 | 27.6 |
| 23 | 2.172 | 22.8 | 83 | 1.659 | 27.2 |
| 24 | 2.221 | 22.8 | 84 | 1.729 | 27.8 |
| 25 | 2.311 | 24.0 | 85 | 2.109 | 33.0 |
| 26 | 2.077 | 24.5 | 86 | 1.490 | 31.8 |
| 27 | 2.105 | 23.8 | 87 | 1.581 | 28.5 |
| 28 | 2.163 | 22.9 | 88 | 1.791 | 28.8 |
| 29 | 2.245 | 22.9 | 89 | 2.077 | 30.9 |
| 30 | 2.335 | 24.1 | 90 | 2.457 | 36.1 |
| 31 | 2.070 | 26.8 | 91 | 1.500 | 32.6 |
| 32 | 2.101 | 24.4 | 92 | 1.629 | 28.2 |
| 33 | 2.171 | 23.2 | 93 | 1.977 | 29.4 |
| 34 | 2.277 | 23.3 | 94 | 2.406 | 32.6 |
| 35 | 2.387 | 24.5 | 95 | 2.786 | 37.8 |
| 36 | 2.073 | 27.6 | 96 | 1.508 | 33.8 |
| 37 | 2.105 | 23.8 | 97 | 1.660 | 28.5 |
| 38 | 2.182 | 23.0 | 98 | 2.081 | 30.1 |
| 39 | 2.303 | 22.7 | 99 | 2.575 | 34.5 |
| 40 | 2.393 | 23.9 | 100 | 2.955 | 39.7 |
| 41 | 2.052 | 23.4 | 101 | 1.470 | 28.5 |
| 42 | 2.103 | 22.8 | 102 | 1.524 | 27.5 |
| 43 | 2.141 | 22.5 | 103 | 1.612 | 26.5 |
| 44 | 2.190 | 22.5 | 104 | 1.721 | 27.7 |
| 45 | 2.280 | 23.7 | 105 | 2.101 | 32.8 |
| 46 | 2.080 | 24.4 | 106 | 1.480 | 30.4 |
| 47 | 2.073 | 23.1 | 107 | 1.538 | 28.1 |
| 48 | 2.124 | 22.7 | 108 | 1.725 | 28.0 |
| 49 | 2.198 | 22.8 | 109 | 2.060 | 30.3 |
| 50 | 2.288 | 24.0 | 110 | 2.440 | 35.5 |
| 51 | 2.045 | 26.6 | 111 | 1.490 | 33.8 |
| 52 | 2.070 | 23.2 | 112 | 1.578 | 29.0 |
| 53 | 2.128 | 23.2 | 113 | 1.808 | 29.1 |
| 54 | 2.219 | 23.2 | 114 | 2.231 | 32.7 |
| 55 | 2.309 | 24.4 | 115 | 2.611 | 37.9 |
| 56 | 2.049 | 27.5 | 116 | 1.498 | 33.8 |
| 57 | 2.075 | 23.6 | 117 | 1.606 | 29.6 |

TABLE 4-continued

| NO. | PRESSURE TRANS-MISSION TIME (μsec) | 6 pl EJECTION VOLTAGE (V) | NO. | PRESSURE TRANS-MISSION TIME (μsec) | 4 pl EJECTION VOLTAGE (V) |
|---|---|---|---|---|---|
| 58 | 2.138 | 23.4 | 118 | 1.892 | 29.1 |
| 59 | 2.239 | 22.6 | 119 | 2.426 | 33.4 |
| 60 | 2.329 | 23.8 | 120 | 2.806 | 38.6 |

Further, the result totalized for each parameter of the lid section 27 is as shown in the following FIG. 9 and FIG. 10. FIG. 9 is a characteristic diagram illustrating the result of the test for evaluating the ejection voltage V1 (V) and the pressure transmission time T1 (μsec) in a case in which the pressure chamber density is 150 dpi. FIG. 9 (A1) is a characteristic diagram illustrating the relation between T1 and the length ratio X (%) between the length L6 of the through hole 28 of the lid section 27 in the longitudinal direction of the pressure chamber 24 and the length L3 of the pressure chamber 24 in the longitudinal direction of the pressure chamber 24. FIG. 9 (A2) is a characteristic diagram illustrating the relation between the ejection voltage V1 and X. FIG. 9 (A3) is a characteristic diagram illustrating the relation between T1 and the thickness L5 of the lid section 27. FIG. 9 (A4) is a characteristic diagram illustrating the relation between the ejection voltage V1 and L5. FIG. 9 (A5) is a characteristic diagram illustrating the relation between T1 and the Young's modulus of the lid section 27. FIG. 9 (A6) is a characteristic diagram illustrating the relation between the ejection voltage V1 and the Young's modulus of the lid section 27.

FIG. 10 is a characteristic diagram illustrating the result of the test for evaluating the ejection voltage V2 (V) and the pressure transmission time T2 (μsec) in a case in which the pressure chamber density is 300 dpi. FIG. 10 (B1) is a characteristic diagram illustrating the relation between T2 and the length ratio Y (%) between the length L6 of the through hole 28 of the lid section 27 in the longitudinal direction of the pressure chamber 24 and the length L3 of the pressure chamber 24 in the longitudinal direction of the pressure chamber 24. FIG. 10 (B2) is a characteristic diagram illustrating the relation between the ejection voltage V2 and Y. FIG. 10 (B3) is a characteristic diagram illustrating the relation between T2 and the thickness L5 of the lid section 27. FIG. 10 (B4) is a characteristic diagram illustrating the relation between the ejection voltage V2 and L5. FIG. 10 (B5) is a characteristic diagram illustrating the relation between T2 and the Young's modulus of the lid section 27. FIG. 10 (B6) is a characteristic diagram illustrating the relation between the ejection voltage V2 and the Young's modulus of the lid section 27.

(Effect)

It can be known from each characteristic diagram shown in FIG. 9 and FIG. 10 that the parameter which has the most influences on the characteristic is the length L6 of the through hole 28 of the lid section 27 in the longitudinal direction of the pressure chamber 24, and that both of the two categories of inkjet heads 11 are used suitably in the range in which the length ratios X and Y of the pressure chamber 24 are 10~25%.

The thinner the thickness (L5) of the lid section 27 is, the better; however, the thickness (L5) of the lid section 27 has less influence on the characteristic compared with the length (L6) of the through hole 28, thus, the lid section 27 may be appropriately manufactured with the handling property, the manufacturability or the cost and the like taken into consideration. The higher the Young's modulus of the lid section 27 is (that is, the firmer the lid section 27 is), the better; however, viewing from the perspective of manufacturability, the manufacturing process becomes more difficult if the lid section 27 is too firm, thus, the Young's modulus of the lid section 27 is preferred to be about 150 GPa.

Moreover, since various kinds of ink are used in the inkjet head 11, thus, the lid section 27 is adhered by thermosetting adhesive in consideration of ink resistance. Thus, the warping of the head 11 is reduced if the coefficient of thermal expansion of the lid section 27 is approximate to that of the piezoelectric member 15. Even if the lid section 27 can be adhered by room temperature curing adhesive, the ink with low viscosity is ejected because of the high temperature when the head 11 is being used. Thus, it is preferred that the coefficient of thermal expansion of the lid section 27 is approximate to that of the piezoelectric member 15, thus, 42Alloy, invar, kovar and the like are preferred.

In addition, in a case in which the lid section 27 is made of these conductive materials, as the lid section 27 is contacted with the electrode 26 of the pressure chamber 24 across the adhesive, thus, an insulating thin film such as $SiO_2$ and the like is formed at the contacting surface.

Thus, the inkjet head 11 with the constitution described above has the following effects. That is, in the inkjet head 11 according to the present embodiment, within each parameter of the thickness (L5), the Young's modulus and the opening length (L6) of the through hole 28 of the lid section 27, the parameter of the opening length (L6) of the through hole 28 has the most influences on the characteristic of the inkjet head 11. The inkjet head 11 according to the present embodiment is set in a range of 10~25% before and after the center, that is, the length ratio (refer to X1 shown in FIG. 9 (A2) and Y1 shown in FIG. 10 (B2)) where the relation between the ejection voltage of the ink ejected from the nozzles 22 and the length ratio between the length (refer to L6 shown in FIG. 7) of the through hole 28 of the lid section 27 in the longitudinal direction of the pressure chamber 24 and the length (refer to L3 shown in FIG. 7) of the pressure chamber 24 in the longitudinal direction of the pressure chamber 24 is minimized. In this way, the opening length (L6) of the through hole 28 is optimized to improve the ink ejection efficiency, reduce the drive voltage, and to increase the drive frequency.

Further, in the present embodiment, the Young's modulus of the lid section 27 is set to 100~200 Gpa. The lid section 27 according to the present embodiment includes the first part 27*a* which covers the pressure chamber 24 and the second part 27*b* which covers the common liquid chamber 41 between the pressure chambers 24. The thickness of the first part 27*a* is set to 30~60 μm, and the second part 27*b* includes the thin part 27*b*2 of which the thickness is thinner than that of the first part 27*a*. Herein, the lid section 27 arranges, for example, groove-shaped cutout portions 27*b*1 at the part of the surface side corresponding to the second part 27*b* to form the thin part 27*b*2. In this way, in the lid section 27, the rigidity of the second part 27*b* is lower than that of the first part 27*a*. In this case, it is possible to suppress the residual vibration caused by the pressure fluctuation of the ink in the chamber 24 used in the first ink ejecting operation, and obtain a damper effect in the common liquid chamber 41 between the pressure chambers 24. Thus, it is possible to prevent that the vibration of the pressure fluctuation of the ink in the chamber 24 used in the first ink ejecting operation is transmitted to the lid section 27, and as a result, other pressure chambers 24 which are not used in the ink ejection vibrate. Thus, it is possible to prevent that other pressure chambers 24 which are not used in the ink ejection are used in the next ink ejecting operation in a vibration state, which can prevent crosstalk in the next ink ejecting operation and improve the printing stability.

In the present embodiment, the lid section 27 is formed by one plate, thus, the manufacture of the lid section 27 can be carried out easily, and the assembly workability of the lid section 27 with other components can be carried out easily when assembling the inkjet head 11.

Further, it is applicable to construct an ink flow path by forming the nozzle plate 14 after the lid section 27 of the pressure chamber 24 is adhered.

In accordance with the embodiment described above, there can be provided an inkjet printer head capable of ejecting ink efficiently at a high speed.

Further, it is also applicable to arrange the electrode 26 up to half without laminating the piezoelectric member 15.

A Third Embodiment

Constitution

Figure 11:
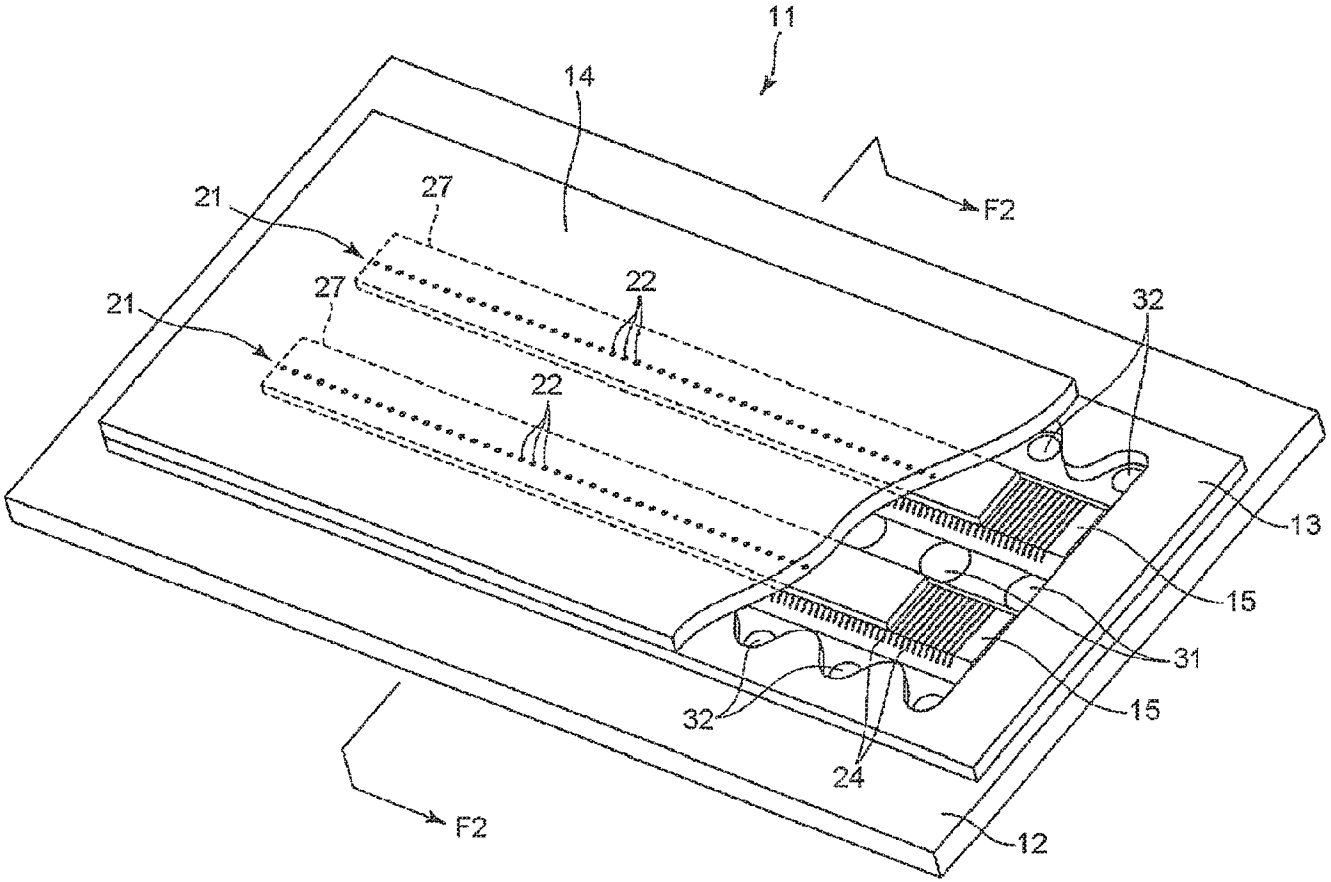
FIG. 11 is a perspective view of an inkjet head according to a third embodiment in which one part of the inkjet head is broken.
Figure 12:
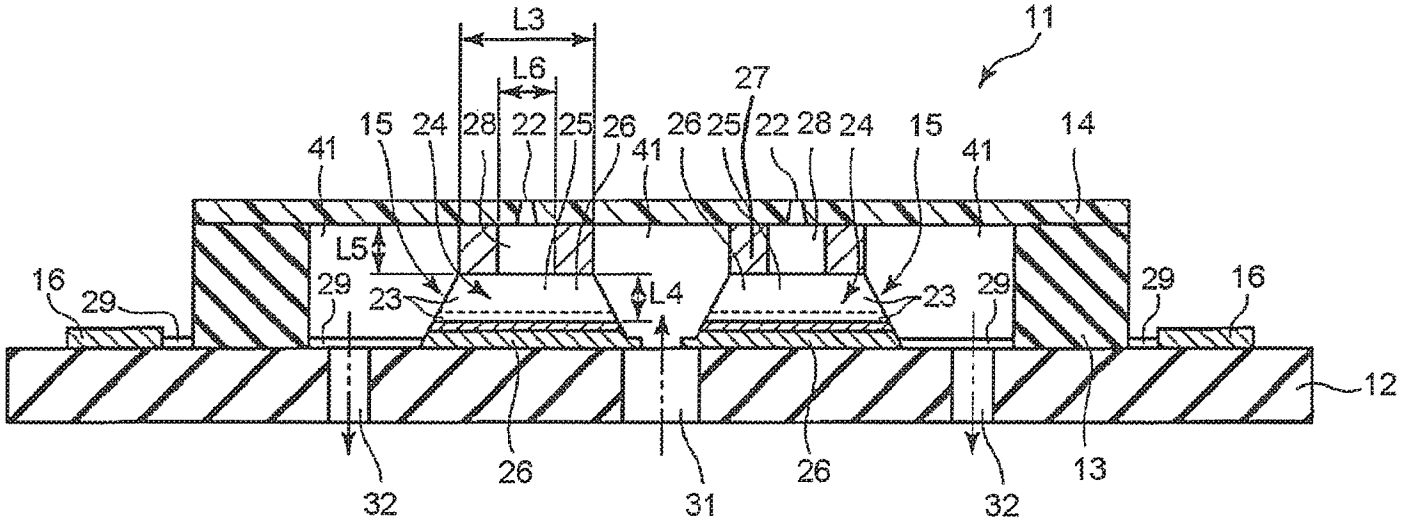
FIG. 12 is a cross-sectional view obtained by cutting at a position of a line F2-F2 shown in FIG. 11.

The third embodiment of the present invention is described with reference to FIG. 11-FIG. 15. The same components as those described in the first embodiment and the second embodiment are indicated by the same reference numerals in the drawings. The inkjet head 11 according to the present embodiment is an ink circulation type inkjet head of a so called share mode share wall type, and has a structure called as a side shooter type. As shown in FIG. 11 and FIG. 12, the inkjet head 11 includes a substrate 12, a frame member 13 adhered to the substrate 12, a nozzle plate 14 adhered to the frame member 13, a piezoelectric member 15 adhered to the substrate 12 at a position inside the frame member 13 and a head drive IC 16 for driving the piezoelectric member 15.

The nozzle plate 14, which is a resin material having a thickness of 25~75 μm, is formed by, for example, a square-shaped polyimide film. The nozzle plate 14 includes a pair of nozzle arrays 21. Each nozzle array 21 includes a plurality of nozzles 22.

The piezoelectric member 15 is formed by binding two piezoelectric plates 23 which are made of, for example, PZT (lead zirconate titanate) in such a manner that the polarization directions thereof are opposite. The piezoelectric member 15, which is trapezoidal, is formed into a rod-shape. The piezoelectric member 15 includes a plurality of pressure chambers 24 formed by grooves cut in the surface, pillar sections 25 serving as driving elements arranged at two sides of each pressure chamber 24 and electrodes 26 formed at the lateral sides of each pillar section 25 and the bottom of the pressure chamber 24.

The nozzle plate 14 is adhered to the pillar sections 25 of the piezoelectric member 15 across a lid section 27 including a strong, rigid material such as metal, ceramics and the like. The piezoelectric member 15 is adhered to the substrate 12 in such a manner that it corresponds to the nozzle arrays 21 on the nozzle plate 14. The pressure chambers 24 and the pillar sections 25 are formed corresponding to the nozzles 22.

Further, through holes 28 connected to each pressure chamber 24 are formed in the lid section 27. In the present embodiment, the lid section 27 is formed by elongated rectangular flat plates corresponding to the outer edge shape of the surface of the piezoelectric member 15. The lid section 27 is only formed at the parts that cover the pressure chamber 24. The thickness of the lid section 27 is set to 30~60 μm, and the Young's modulus of the lid section 27 is set to 100~200 Gpa. The nozzles 22 of the nozzle plate 14 are opened in a state of being connected to each through hole 28. A plurality of electrical wiring 29 is arranged on the substrate 12. One end of each electrical wiring 29 is connected with the electrode 26 and the other end is connected with the head drive IC 16.

The substrate 12 is formed by, for example, ceramic such as alumina and the like into a square-shaped plate. The substrate 12 includes supply ports 31 and discharge ports 32 which are formed by holes. The supply port 31 is connected with an ink tank of a printer (not shown), and the discharge port 32 is connected with an ink tank (not shown). During the operation of the inkjet head 11, the ink supply is carried out through the supply port 31, and the ink flowing out from the ink tank is filled into the pressure chamber 24 via the supply port 31. The ink that is not used in the pressure chamber 24 is collected to the ink tank through the discharge port 32. The inkjet head 11 according to the present embodiment is a circulation type head which can circulate the ink in the pressure chamber 24 and remove the entrained air bubbles automatically.

Figure 13:
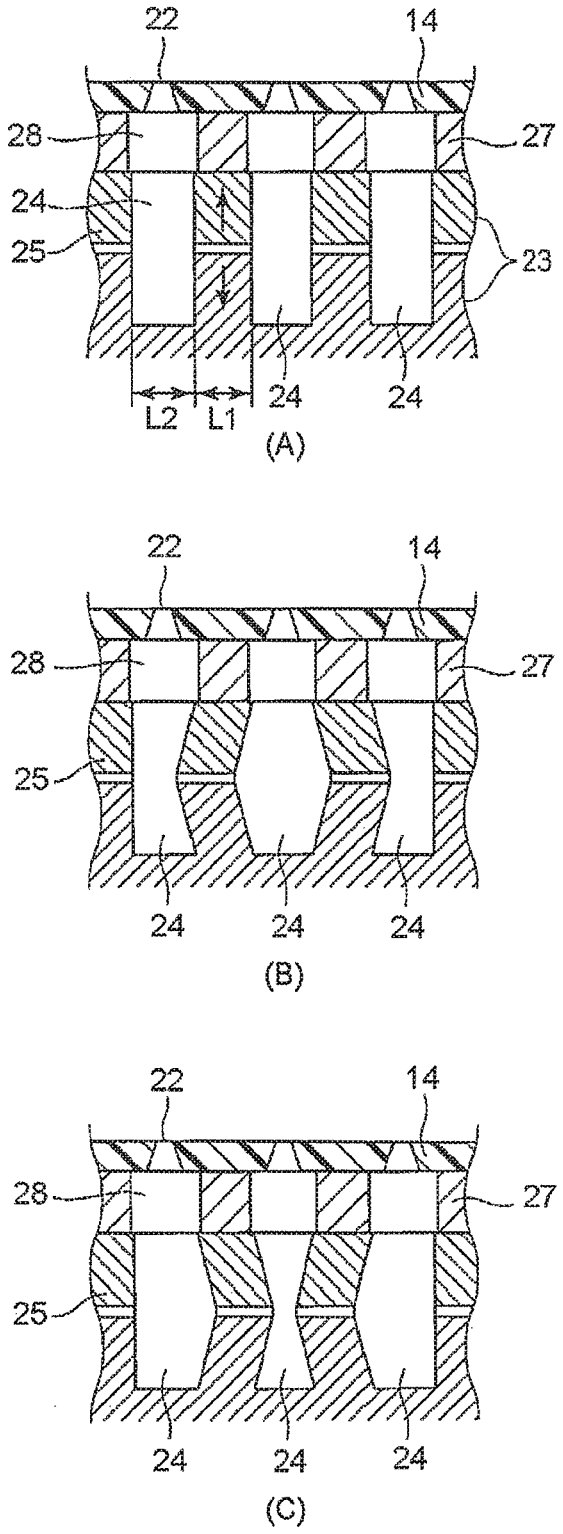
FIG. 13 is a diagram illustrating the operation of the inkjet head according to the third embodiment, (A) is a longitudinal section view illustrating the main portions of the components around a pressure chamber, (B) is a longitudinal section view illustrating the main portions in a state in which the pressure chamber is depressurized, and (C) is a longitudinal section view illustrating the main portions in a state in which the pressure chamber is pressurized to eject ink.

The operation of the inkjet head 11 is described with reference to FIG. 13 (A)~(C). FIG. 13 (A) is a longitudinal section view illustrating the main portions of the components around the pressure chamber 24, FIG. 13 (B) is a longitudinal section view illustrating the main portions in a state in which the pressure chamber 24 is depressurized (a state in which the pressure chamber 24 is enlarged), and FIG. 13 (C) is a longitudinal section view illustrating the main portions in a state in which the pressure chamber 24 is pressurized to eject ink (a state in which the pressure chamber 24 is contracted). When a user instructs the printer to carry out printing, the control section of the printer outputs a print signal to the head drive IC 16 of the inkjet head 11. After the print signal is received, the head drive IC 16 applies a driving pulse voltage to the pillar section 25 through the electrical wiring 29. In this way, the pair of pillar sections 25 at two sides is deformed (curved) into a "<" shape in opposite directions by performing shear mode deformation. At this time, as shown in FIG. 13 (B), the pressure chamber 24 is depressurized (enlarged). Then, as shown in FIG. 13 (C), these are returned to an initial position and the pressure in the pressure chamber 24 is increased (pressure chamber 24 is contracted). In this way, the ink in the pressure chamber 24 is supplied to the nozzle 22 of the nozzle plate 14 via the through hole 28 of the lid section 27, and the ink drops are ejected from the nozzle 22 vigorously.

In such an inkjet head 11, the lid section 27 constitutes one wall surface of the pressure chamber 24, which brings influences on the rigidity of the pressure chamber 24. The higher the rigidity of the lid section 27 is (that is, the more rigid/thick the lid section 27 is), the higher the rigidity of the pressure chamber 24 is; thus, the pressure generated in the piezoelectric member 15 is used efficiently in the ink ejection, and the pressure transmission speed in the ink is increased, and the high-speed driving can be carried out. Herein, it is necessary to arrange openings of through holes 28 connected to the nozzles 22 in the lid section 27, thus, if the thickness of the lid section 27 is too thick, the fluid resistance until the nozzles 22 is increased, which decreases the ejection efficiency. On the contrary, if the openings of the through holes 28 of the lid section 27 are enlarged to avoid the decrease in the ejection efficiency, the rigidity of the pressure chamber 24 is decreased, and the pressure chamber 24 is also increased, which leads to a decrease in the pressure transmission speed. Thus, it is considered that there is an optimum value for the thickness of the lid section 27 and the size of the through hole 28.

Figure 14:
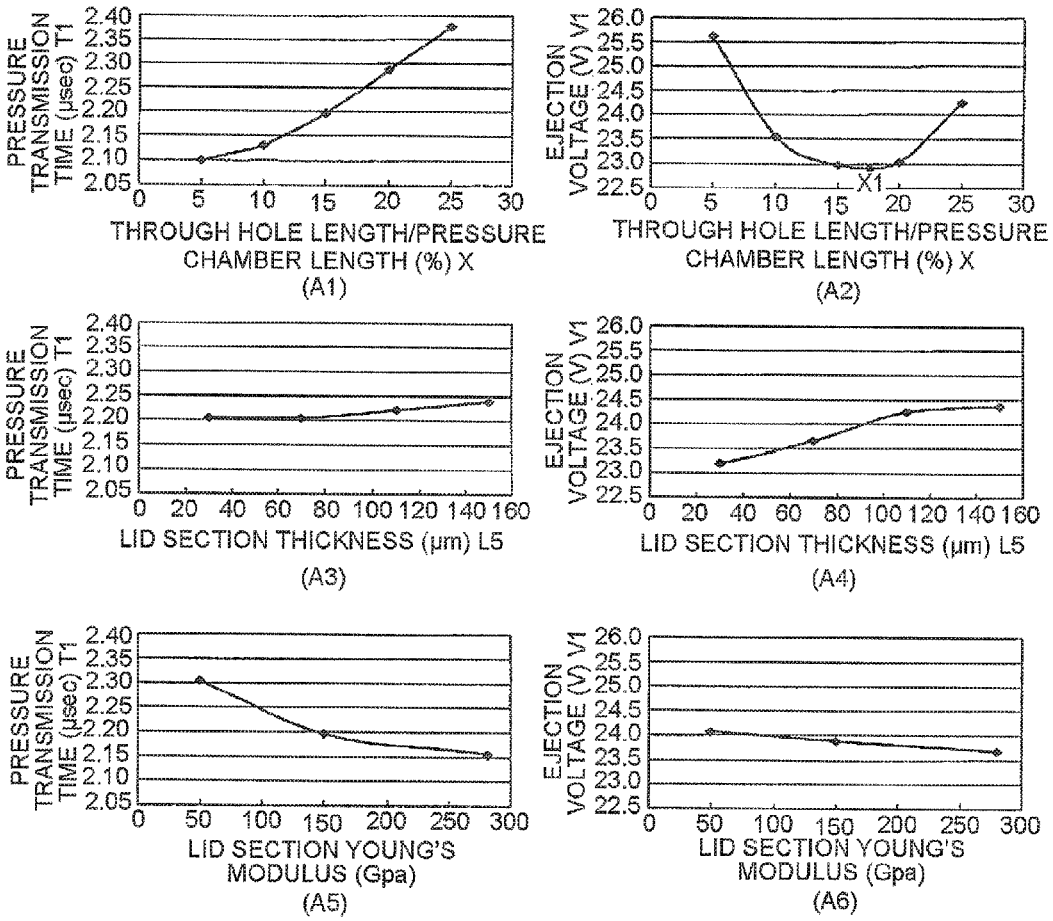
FIG. 14 is a characteristic diagram illustrating results of a test for evaluating ejection voltage and pressure transmission time in a case in which a pressure chamber density is 150 dpi in a case in which the inkjet head according to the third embodiment is prototyped by reference to a table 5.
Figure 15:
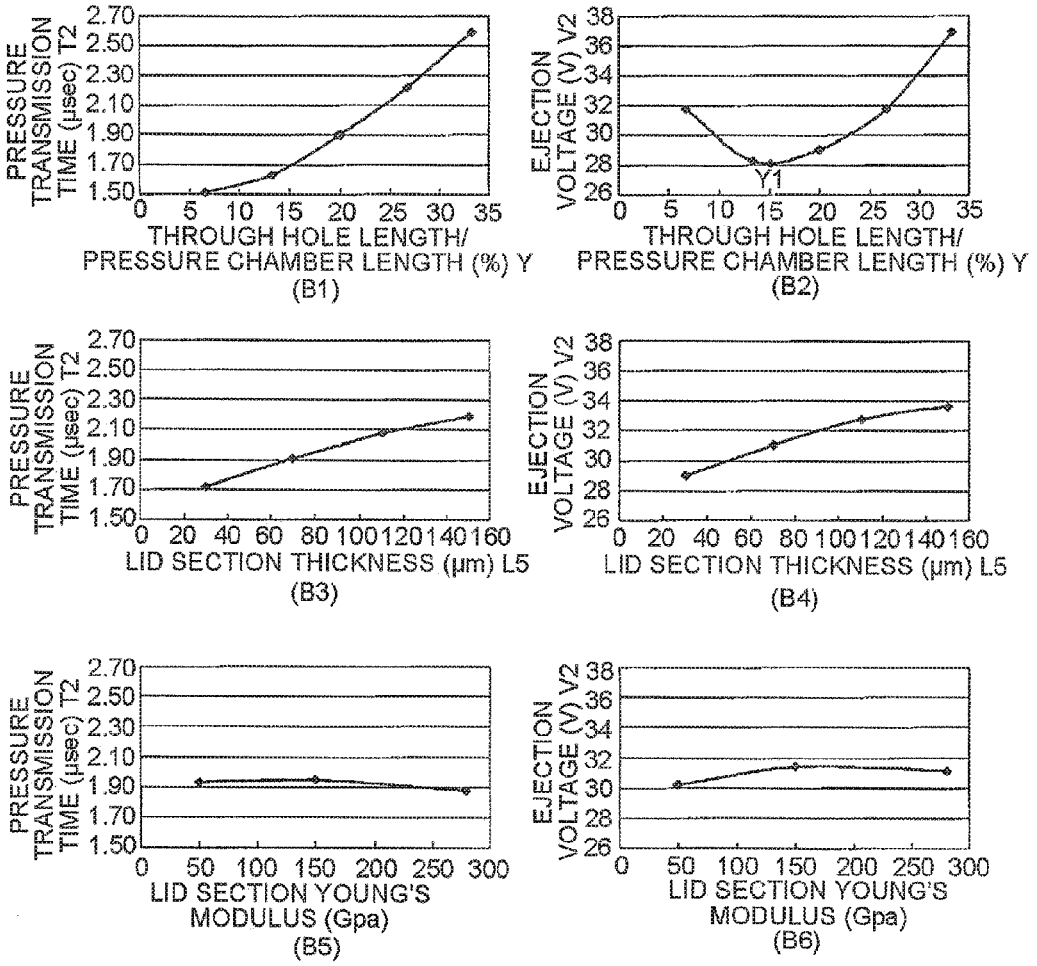
FIG. 15 is a characteristic diagram illustrating results of a test for evaluating ejection voltage and pressure transmission time in a case in which a pressure chamber density is 300 dpi in a case in which the inkjet head according to the third embodiment is prototyped by reference to a table 5.

The inkjet head 11 according to the present embodiment is set in a range of 10~25% before and after a center, that is, a length ratio (refer to a minimum value X1 shown in FIG. 14 (A2) and a minimum value Y1 shown in FIG. 15 (B2)) where the relation between the ejection voltage of the ink ejected from the nozzles 22 and a length ratio between the length (refer to L6 shown in FIG. 12) of the through hole 28 of the lid section 27 in the longitudinal direction of the pressure chamber 24 and the length (refer to L3 shown in FIG. 12) of the pressure chamber 24 in the longitudinal direction of the pressure chamber 24 is minimized.

(Prototype of Inkjet Head 11)

The inkjet head 11 is prototyped by reference to the following table 5.

TABLE 5

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 1 | 169 | 80 | 2000 | 300 | 50 | 30 | 100 |
| 2 | | | | | | | 200 |
| 3 | | | | | | | 300 |
| 4 | | | | | | | 400 |
| 5 | | | | | | | 500 |
| 6 | | | | | | 70 | 100 |
| 7 | | | | | | | 200 |
| 8 | | | | | | | 300 |
| 9 | | | | | | | 400 |
| 10 | | | | | | | 500 |
| 11 | | | | | | 110 | 100 |
| 12 | | | | | | | 200 |
| 13 | | | | | | | 300 |
| 14 | | | | | | | 400 |
| 15 | | | | | | | 500 |
| 16 | | | | | | 150 | 100 |
| 17 | | | | | | | 200 |
| 18 | | | | | | | 300 |
| 19 | | | | | | | 400 |
| 20 | | | | | | | 500 |

TABLE 5-continued

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 21 | | | | | 150 | 30 | 100 |
| 22 | | | | | | | 200 |
| 23 | | | | | | | 300 |
| 24 | | | | | | | 400 |
| 25 | | | | | | | 500 |
| 26 | | | | | | 70 | 100 |
| 27 | | | | | | | 200 |
| 28 | | | | | | | 300 |
| 29 | | | | | | | 400 |
| 30 | | | | | | | 500 |
| 31 | | | | | | 110 | 100 |
| 32 | | | | | | | 200 |
| 33 | | | | | | | 300 |
| 34 | | | | | | | 400 |
| 35 | | | | | | | 500 |
| 36 | | | | | | 150 | 100 |
| 37 | | | | | | | 200 |
| 38 | | | | | | | 300 |
| 39 | | | | | | | 400 |
| 40 | | | | | | | 500 |
| 41 | | | | | 250 | 30 | 100 |
| 42 | | | | | | | 200 |
| 43 | | | | | | | 300 |
| 44 | | | | | | | 400 |
| 45 | | | | | | | 500 |
| 46 | | | | | | 70 | 100 |
| 47 | | | | | | | 200 |
| 48 | | | | | | | 300 |
| 49 | | | | | | | 400 |
| 50 | | | | | | | 500 |
| 51 | | | | | | 110 | 100 |
| 52 | | | | | | | 200 |
| 53 | | | | | | | 300 |
| 54 | | | | | | | 400 |
| 55 | | | | | | | 500 |
| 56 | | | | | | 150 | 100 |
| 57 | | | | | | | 200 |
| 58 | | | | | | | 300 |
| 59 | | | | | | | 400 |
| 60 | | | | | | | 500 |
| 61 | 84.5 | 40 | 1500 | 150 | 50 | 30 | 100 |
| 62 | | | | | | | 200 |
| 63 | | | | | | | 300 |
| 64 | | | | | | | 400 |
| 65 | | | | | | | 500 |
| 66 | | | | | | 70 | 100 |
| 67 | | | | | | | 200 |
| 68 | | | | | | | 300 |
| 69 | | | | | | | 400 |
| 70 | | | | | | | 500 |
| 71 | | | | | | 110 | 100 |
| 72 | | | | | | | 200 |
| 73 | | | | | | | 300 |
| 74 | | | | | | | 400 |
| 75 | | | | | | | 500 |
| 76 | | | | | | 150 | 100 |
| 77 | | | | | | | 200 |
| 78 | | | | | | | 300 |
| 79 | | | | | | | 400 |
| 80 | | | | | | | 500 |
| 81 | | | | | 150 | 30 | 100 |
| 82 | | | | | | | 200 |
| 83 | | | | | | | 300 |
| 84 | | | | | | | 400 |
| 85 | | | | | | | 500 |
| 86 | | | | | | 70 | 100 |
| 87 | | | | | | | 200 |
| 88 | | | | | | | 300 |
| 89 | | | | | | | 400 |
| 90 | | | | | | | 500 |
| 91 | | | | | | 110 | 100 |
| 92 | | | | | | | 200 |
| 93 | | | | | | | 300 |

TABLE 5-continued

| | PRESSURE CHAMBER | | | | LID SECTION | | |
|---|---|---|---|---|---|---|---|
| | | | | | YOUNG'S | | OPENING |
| NO. | PITCH μm | WIDTH μm | LENGTH μm | DEPTH μm | MODULUS Gpa | THICKNESS μm | LENGTH μm |
| 94 | | | | | | | 400 |
| 95 | | | | | | | 500 |
| 96 | | | | | | 150 | 100 |
| 97 | | | | | | | 200 |
| 98 | | | | | | | 300 |
| 99 | | | | | | | 400 |
| 100 | | | | | | | 500 |
| 101 | | | | | 250 | 30 | 100 |
| 102 | | | | | | | 200 |
| 103 | | | | | | | 300 |
| 104 | | | | | | | 400 |
| 105 | | | | | | | 500 |
| 106 | | | | | | 70 | 100 |
| 107 | | | | | | | 200 |
| 108 | | | | | | | 300 |
| 109 | | | | | | | 400 |
| 110 | | | | | | | 500 |
| 111 | | | | | | 110 | 100 |
| 112 | | | | | | | 200 |
| 113 | | | | | | | 300 |
| 114 | | | | | | | 400 |
| 115 | | | | | | | 500 |
| 116 | | | | | | 150 | 100 |
| 117 | | | | | | | 200 |
| 118 | | | | | | | 300 |
| 119 | | | | | | | 400 |
| 120 | | | | | | | 500 |

The head 11 is broadly classified into two categories, and two representative categories of heads, that is, one with a pressure chamber density of 150 dpi and one with a pressure chamber density of 300 dpi, are prototyped. In the table 5, as to the pressure chambers 24 in samples No. 1~60, the pitch (L1) is 169 μm, the width (L2) is 80 μm, the length (L3) is 2000 μm, and the depth (L4) is 300 μm. As to the pressure chambers 24 in samples No. 61~120, the pitch (L1) is 84.5 μm, the width (L2) is 40 μm, the length (L3) is 1500 μm, and the depth (L4) is 150 μm. Further, the Young's modulus (Gpa), the thickness (L5) and the opening length (L6) of the through hole 28 of the lid section 27 are set as shown in the table 5. The material of the lid section 27 may be PZT of which the Young's modulus is about 50 GPa, Ni—Fe alloy (42Alloy) of which the Young's modulus is about 150 GPa and 92alumina of which the Young's modulus is about 250 GPa; and the width of the through hole 28 of the lid section 27 is approximately equal to the width (L2) of the pressure chamber 24.

(Test)

The ejection voltage (the voltage required to eject a certain amount of ink drops at a predetermined driving speed) and the pressure transmission time (the time the pressure transmits in the pressure chamber; in inverse proportion to the pressure transmission speed) are evaluated for each inkjet head 11 shown in the samples No. 1~120. The test results are as shown in the following table 6.

TABLE 6

| NO. | PRESSURE TRANSMISSION TIME (μsec) | 6 pl EJECTION VOLTAGE (V) | 4 pl EJECTION VOLTAGE (V) |
|---|---|---|---|
| 1 | 2.180 | 23.3 | |
| 2 | 2.209 | 23.2 | |

TABLE 6-continued

| NO. | PRESSURE TRANSMISSION TIME (μsec) | 6 pl EJECTION VOLTAGE (V) | 4 pl EJECTION VOLTAGE (V) |
|---|---|---|---|
| 3 | 2.251 | 22.9 | |
| 4 | 2.286 | 23.0 | |
| 5 | 2.386 | 24.2 | |
| 6 | 2.159 | 25.2 | |
| 7 | 2.199 | 23.4 | |
| 8 | 2.270 | 23.2 | |
| 9 | 2.359 | 23.4 | |
| 10 | 2.449 | 24.6 | |
| 11 | 2.155 | 26.2 | |
| 12 | 2.202 | 23.9 | |
| 13 | 2.297 | 23.0 | |
| 14 | 2.429 | 23.6 | |
| 15 | 2.519 | 24.8 | |
| 16 | 2.158 | 27.7 | |
| 17 | 2.208 | 24.4 | |
| 18 | 2.319 | 23.1 | |
| 19 | 2.480 | 23.7 | |
| 20 | 2.570 | 24.9 | |
| 21 | 2.105 | 24.2 | |
| 22 | 2.132 | 22.7 | |
| 23 | 2.172 | 22.8 | |
| 24 | 2.221 | 22.8 | |
| 25 | 2.311 | 24.0 | |
| 26 | 2.077 | 24.5 | |
| 27 | 2.105 | 23.8 | |
| 23 | 2.163 | 22.9 | |
| 22 | 2.245 | 22.9 | |
| 20 | 2.335 | 24.1 | |
| 31 | 2.070 | 26.8 | |
| 32 | 2.101 | 24.4 | |
| 33 | 2.171 | 23.2 | |
| 34 | 2.277 | 23.3 | |
| 35 | 2.367 | 24.5 | |
| 38 | 2.073 | 27.6 | |
| 37 | 2.105 | 23.8 | |
| 36 | 2.182 | 23.0 | |

TABLE 6-continued

| NO. | PRESSURE TRANSMISSION TIME (μsec) | 6 pl EJECTION VOLTAGE (V) | 4 pl EJECTION VOLTAGE (V) |
|---|---|---|---|
| 39 | 2.303 | 22.7 | |
| 40 | 2.393 | 23.9 | |
| 41 | 2.052 | 23.4 | |
| 42 | 2.103 | 22.8 | |
| 43 | 2.141 | 22.5 | |
| 44 | 2.190 | 22.5 | |
| 45 | 2.250 | 23.7 | |
| 46 | 2.050 | 24.4 | |
| 47 | 2.073 | 23.1 | |
| 48 | 2.124 | 22.7 | |
| 49 | 2.195 | 22.8 | |
| 50 | 2.288 | 24.0 | |
| 51 | 2.045 | 26.6 | |
| 52 | 2.070 | 23.2 | |
| 53 | 2.128 | 23.2 | |
| 54 | 2.219 | 23.2 | |
| 55 | 2.309 | 24.4 | |
| 58 | 2.049 | 27.5 | |
| 57 | 2.075 | 23.6 | |
| 58 | 2.138 | 23.4 | |
| 59 | 2.239 | 22.6 | |
| 60 | 2.329 | 23.8 | |
| 61 | 1.546 | | 28.9 |
| 62 | 1.613 | | 28.0 |
| 63 | 1.722 | | 27.4 |
| 64 | 1.799 | | 28.3 |
| 65 | 2.179 | | 33.5 |
| 66 | 1.565 | | 30.8 |
| 67 | 1.715 | | 27.7 |
| 68 | 1.980 | | 29.9 |
| 69 | 2.222 | | 32.2 |
| 70 | 2.602 | | 37.4 |
| 71 | 1.563 | | 33.0 |
| 72 | 1.785 | | 28.4 |
| 73 | 2.232 | | 31.8 |
| 74 | 2.578 | | 35.0 |
| 75 | 2.958 | | 40.2 |
| 76 | 1.584 | | 34.4 |
| 77 | 1.506 | | 26.6 |
| 78 | 2.430 | | 32.2 |
| 79 | 2.827 | | 36.5 |
| 80 | 3.207 | | 41.7 |
| 81 | 1.485 | | 29.8 |
| 82 | 1.547 | | 27.6 |
| 83 | 1.659 | | 27.2 |
| 84 | 1.729 | | 27.8 |
| 85 | 2.109 | | 33.0 |
| 86 | 1.490 | | 31.8 |
| 87 | 1.581 | | 28.5 |
| 88 | 1.791 | | 28.8 |
| 89 | 2.077 | | 30.9 |
| 90 | 2.457 | | 36.1 |
| 91 | 1.500 | | 32.6 |
| 92 | 1.629 | | 28.2 |
| 93 | 1.977 | | 29.4 |
| 94 | 2.406 | | 32.6 |
| 95 | 2.786 | | 37.8 |
| 96 | 1.508 | | 33.8 |
| 97 | 1.660 | | 28.5 |
| 98 | 2.081 | | 30.1 |
| 99 | 2.575 | | 34.5 |
| 100 | 2.955 | | 39.7 |
| 101 | 1.470 | | 28.5 |
| 102 | 1.524 | | 27.5 |
| 103 | 1.612 | | 26.8 |
| 104 | 1.721 | | 27.7 |
| 105 | 2.101 | | 32.8 |
| 106 | 1.480 | | 30.4 |
| 107 | 1.538 | | 28.1 |
| 108 | 1.725 | | 28.0 |
| 109 | 2.060 | | 30.3 |
| 110 | 2.440 | | 35.5 |
| 111 | 1.490 | | 33.8 |
| 112 | 1.578 | | 29.0 |
| 113 | 1.808 | | 29.1 |
| 114 | 2.231 | | 32.7 |

TABLE 6-continued

| NO. | PRESSURE TRANSMISSION TIME (μsec) | 6 pl EJECTION VOLTAGE (V) | 4 pl EJECTION VOLTAGE (V) |
|---|---|---|---|
| 115 | 2.611 | | 37.9 |
| 118 | 1.498 | | 33.5 |
| 117 | 1.606 | | 29.6 |
| 118 | 1.892 | | 29.1 |
| 119 | 2.426 | | 33.4 |
| 120 | 2.806 | | 35.6 |

Further, the result totalized for each parameter of the lid section 27 is as shown in the following FIG. 14 and FIG. 15. FIG. 14 is a characteristic diagram illustrating the result of the test for evaluating the ejection voltage V1 (V) and the pressure transmission time T1 (μsec) in a case in which the pressure chamber density is 150 dpi. FIG. 14 (A1) is a characteristic diagram illustrating the relation between T1 and the length ratio X (%) between the length L6 of the through hole 28 of the lid section 27 in the longitudinal direction of the pressure chamber 24 and the length L3 of the pressure chamber 24 in the longitudinal direction of the pressure chamber 24. FIG. 14 (A2) is a characteristic diagram illustrating the relation between the ejection voltage V1 and X. FIG. 14 (A3) is a characteristic diagram illustrating the relation between T1 and the thickness L5 of the lid section 27. FIG. 14 (A4) is a characteristic diagram illustrating the relation between the ejection voltage V1 and L5. FIG. 14 (A5) is a characteristic diagram illustrating the relation between T1 and the Young's modulus of the lid section 27. FIG. 14 (A6) is a characteristic diagram illustrating the relation between the ejection voltage V1 and the Young's modulus of the lid section 27.

FIG. 15 is a characteristic diagram illustrating the result of the test for evaluating the ejection voltage V2 (V) and the pressure transmission time T2 (μsec) in a case in which the pressure chamber density is 300 dpi. FIG. 15 (B1) is a characteristic diagram illustrating the relation between T2 and the length ratio Y (%) between the length L6 of the through hole 28 of the lid section 27 in the longitudinal direction of the pressure chamber 24 and the length L3 of the pressure chamber 24 in the longitudinal direction of the pressure chamber 24. FIG. 15 (B2) is a characteristic diagram illustrating the relation between the ejection voltage V2 and Y. FIG. 15 (B3) is a characteristic diagram illustrating the relation between T2 and the thickness L5 of the lid section 27. FIG. 15 (B4) is a characteristic diagram illustrating the relation between the ejection voltage V2 and L5. FIG. 15 (B5) is a characteristic diagram illustrating the relation between T2 and the Young's modulus of the lid section 27. FIG. 15 (B6) is a characteristic diagram illustrating the relation between the ejection voltage V2 and the Young's modulus of the lid section 27.

(Effect)

It can be known from each characteristic diagram shown in FIG. 14 and FIG. 15 that the parameter which has the most influences on the characteristic is the length L6 of the through hole 28 of the lid section 27 in the longitudinal direction of the pressure chamber 24, and that both of the two categories of inkjet heads 11 are used suitably in the range in which the length ratios X and Y of the pressure chamber 24 are 10~25%.

The thinner the thickness (L5) of the lid section 27 is, the better; however, the thickness (L5) of the lid section 27 has less influence on the characteristic compared with the length (L6) of the through hole 28, thus, the lid section 27 may be appropriately manufactured with the handling property, the manufacturability or the cost and the like taken into consideration. The higher the Young's modulus of the lid section 27 is (that is, the firmer the lid section 27 is), the better; however, viewing from the perspective of manufacturability, the manufacturing process becomes more difficult if the lid section 27 is too firm, thus, the Young's modulus of the lid section 27 is preferred to be about 150 GPa.

Moreover, since various kinds of ink are used in the inkjet head 11, thus, the lid section 27 is adhered by thermosetting adhesive in consideration of ink resistance. Thus, the warping of the head 11 is reduced if the coefficient of thermal expansion of the lid section 27 is approximate to that of the piezoelectric member 15. Even if the lid section 27 can be adhered by room temperature curing adhesive, the ink with low viscosity is ejected because of the high temperature when the head 11 is being used. Thus, it is preferred that the coefficient of thermal expansion of the lid section 27 is approximate to that of the piezoelectric member 15, thus, 42Alloy, invar, kovar and the like are preferred.

In addition, in a case in which the lid section 27 is made of these conductive materials, as the lid section 27 is contacted with the electrode 26 of the pressure chamber 24 across the adhesive, thus, an insulating thin film such as $SiO_2$ and the like is formed at the contacting surface.

Thus, the inkjet head 11 with the constitution described above has the following effects. That is, in the inkjet head 11 according to the present embodiment, within each parameter of the thickness (L5), the Young's modulus and the opening length (L6) of the through hole 28 of the lid section 27, the parameter of the opening length (L6) of the through hole 28 has the most influences on the characteristic of the inkjet head 11. The inkjet head 11 according to the present embodiment is set in a range of 10~25% before and after the center, that is, the length ratio (refer to X1 shown in FIG. 14 (A2) and Y1 shown in FIG. 15 (B2)) where the relation between the ejection voltage of the ink ejected from the nozzles 22 and the length ratio between the length (refer to L6 shown in FIG. 12) of the through hole 28 of the lid section 27 in the longitudinal direction of the pressure chamber 24 and the length (refer to L3 shown in FIG. 12) of the pressure chamber 24 in the longitudinal direction of the pressure chamber 24 is minimized. In this way, the opening length (L6) of the through hole 28 is optimized to improve the ink ejection efficiency, reduce the drive voltage, and to increase the drive frequency.

Further, in the present embodiment, the lid section 27 is only formed at the parts that cover the pressure chamber 24; and the thickness of the lid section 27 at the parts that cover the pressure chamber 24 is set to 30~60 μm, and the Young's modulus of the lid section 27 is set to 100~200 Gpa. In this way, it is possible to obtain a damper effect in the common liquid chamber 41 between the pressure chambers 24, thus, it is possible to reduce the residual vibration caused by the pressure fluctuation of the ink in the chamber 24 used in the first ink ejecting operation. Thus, it is possible to prevent that the pressure fluctuation of the ink in the chamber 24 used in the first ink ejecting operation is transmitted to the lid section 27, and as a result, other pressure chambers 24 which are not used in the ink ejection vibrate. Thus, it is possible to prevent that other pressure chambers 24 which are not used in the ink ejection are used in the next ink ejecting operation in a vibration state, which can prevent crosstalk in the next ink ejecting operation and improve the printing stability.

In the present embodiment, the lid section 27 is formed by elongated rectangular flat plates corresponding to the outer edge shape of the surface of the piezoelectric member 15, thus, the used material can be reduced, which can contribute to the decrease in the material cost.

Further, it is applicable to construct an ink flow path by forming the nozzle plate 14 after the lid section 27 of the pressure chamber 24 is adhered.

In accordance with the embodiment described above, there can be provided an inkjet printer head capable of ejecting ink efficiently at a high speed.

Further, it is also applicable to arrange the electrode 26 up to half without laminating the piezoelectric member 15.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head comprising:

a plurality of groove-shaped pressure chambers configured to be formed on piezoelectric members of which the polarization directions are opposite;

a nozzle plate arranged at the lateral side of the pressure chambers across a lid section with high rigidity; and a lid section in which a plurality of through holes connected to a plurality of nozzles formed on the nozzle plate is formed; wherein the Young's modulus of the lid section is set to 100~200 Gpa, the thickness of a first part of the lid section that covers the pressure chamber is set to 30~60 μm, and a thin part of which the thickness is thinner than that of the first part is arranged at a second part that covers a common liquid chamber between the pressure chambers; and the nozzle plate is formed by a resin material having a thickness of 25~75 μm.

2. The inkjet printer head according to claim 1, wherein the thin part of the second part of the lid section is set to be half as thick as the first part.

3. The inkjet printer head according to claim 2, wherein the lid section is metal with low coefficient of thermal expansion.

4. The inkjet printer head according to claim 3, wherein the inkjet printer head is a side shooter type device serving as a share mode share wall type inkjet printer head.

5. The inkjet printer head according to claim 4, wherein the piezoelectric member includes two PZT laminating plates of which the polarization directions are opposite.

6. An inkjet head comprising:

a plurality of groove-shaped pressure chambers configured to be formed on piezoelectric members of which the polarization directions are opposite;

a nozzle plate arranged at the lateral side of the pressure chambers across a lid section with high rigidity; and a lid section in which a plurality of through holes connected to a plurality of nozzles formed on the nozzle plate is formed; wherein the lid section sets the thickness of the part which covers the pressure chamber to 30~60 μm, and sets the Young's modulus to 100~200 Gpa; and the nozzle plate is formed by a resin material having a thickness of 25~75 μm.

7. The inkjet printer head according to claim 6, wherein the lid section is formed by a flat plate of a size covering the pressure chambers.

8. The inkjet printer head according to claim 7, wherein the lid section is metal with low coefficient of thermal expansion.

9. The inkjet printer head according to claim 8, wherein the inkjet printer head is a side shooter type device serving as a share mode share wall type inkjet printer head.

10. The inkjet printer head according to claim 9, wherein the piezoelectric member includes two PZT laminating plates of which the polarization directions are opposite.

* * * * *